US012004606B2

(12) United States Patent
Martinson et al.

(10) Patent No.: US 12,004,606 B2
(45) Date of Patent: Jun. 11, 2024

(54) SYSTEMS AND METHODS FOR EXTRUDED ZIPPERS, ZIPPER GARAGES, CONNECTION TECHNIQUES, AND USES THEREFORE

(71) Applicant: NITE IZE, INC., Boulder, CO (US)

(72) Inventors: Daniel J. Martinson, Medina, MN (US); Kent H. Brightman, Rogers, MN (US); Bowden Ormsbee, Longmont, CO (US); Richard Case, Boulder, CO (US)

(73) Assignee: Nite Ize, Inc., Boulder, CO (US)

( * ) Notice: Subject to any disclaimer, the term of this patent is extended or adjusted under 35 U.S.C. 154(b) by 22 days.

(21) Appl. No.: 17/450,969

(22) Filed: Oct. 14, 2021

(65) Prior Publication Data

US 2022/0031028 A1 Feb. 3, 2022

Related U.S. Application Data

(63) Continuation of application No. 16/278,550, filed on Feb. 18, 2019, now Pat. No. 11,696,623, which is a (Continued)

(51) Int. Cl.
*A44B 19/16* (2006.01)
*A44B 19/32* (2006.01)

(Continued)

(52) U.S. Cl.
CPC ..... *A44B 19/16* (2013.01); *A44B 19/32* (2013.01); *A44B 19/36* (2013.01); *A44B 19/42* (2013.01);

(Continued)

(58) Field of Classification Search
CPC ..... A44B 19/16; A44B 19/32; A44B 19/36; A44B 19/42; B65D 33/2508; B65D 33/2541

See application file for complete search history.

(56) References Cited

U.S. PATENT DOCUMENTS 2,800,699 A 7/1957 Armstrong
2,923,992 A 2/1960 Armstrong et al.

(Continued)

FOREIGN PATENT DOCUMENTS

CN 1853521 A 11/2006
CN 1939180 A 4/2007

(Continued)

OTHER PUBLICATIONS

Office Action with Search Report dated Jan. 25, 2018 issued in parallel Chinese Patent App. No. 201580072320.0 (13 pages with English translation).

(Continued)

*Primary Examiner* — Tara Schimpf
*Assistant Examiner* — Matthew J Sullivan
(74) *Attorney, Agent, or Firm* — Haynes and Boone, LLP

(57) ABSTRACT

A slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion and the overmolded body is molded over a portion of the zipper.

15 Claims, 22 Drawing Sheets

Related U.S. Application Data continuation of application No. 16/278,548, filed on Feb. 18, 2019, now Pat. No. 11,464,297, which is a continuation of application No. 16/211,128, filed on Dec. 5, 2018, now Pat. No. 11,109,650, which is a continuation of application No. 15/612,926, filed on Jun. 2, 2017, now Pat. No. 11,006,702, which is a continuation of application No. PCT/US2015/063451, filed on Dec. 2, 2015.

(60) Provisional application No. 62/087,687, filed on Dec. 4, 2014.

(51) Int. Cl.
*A44B 19/36* (2006.01)
*A44B 19/42* (2006.01)
*B65D 33/25* (2006.01)

(52) U.S. Cl.
CPC ..... *B65D 33/2508* (2013.01); *B65D 33/2541* (2013.01)

(56) References Cited

U.S. PATENT DOCUMENTS

| | | | | |
|---|---|---|---|---|
| 3,101,109 | A | 8/1963 | Lawrence et al. | |
| 4,223,425 | A | 9/1980 | Akashi | |
| 4,524,493 | A | 6/1985 | Inamura | |
| 4,825,514 | A | 5/1989 | Akeno | |
| 4,947,525 | A | 8/1990 | Van Erden | |
| 5,189,764 | A | 3/1993 | Herrington et al. | |
| 5,608,952 | A * | 3/1997 | Wilder | A44B 19/388 24/433 |
| 5,681,115 | A | 10/1997 | Diederich | |
| 5,947,603 | A | 9/1999 | Tilman | |
| 5,991,980 | A | 11/1999 | Meager | |
| 7,565,722 | B2 | 7/2009 | Kusayama et al. | |
| 7,882,602 | B2 | 2/2011 | Himi | |
| 8,104,147 | B2 | 1/2012 | Peano | |
| 8,438,706 | B2 | 5/2013 | Brightman | |
| 8,677,570 | B2 | 3/2014 | Swain et al. | |
| 9,295,307 | B2 | 3/2016 | Tominaga et al. | |
| 9,538,817 | B2 * | 1/2017 | Ogura | A44B 19/267 |
| 9,545,134 | B1 | 1/2017 | Tan | |
| 9,795,195 | B2 * | 10/2017 | Martinson | B29D 5/10 |
| 2003/0115725 | A1 | 6/2003 | Matsumoto et al. | |
| 2003/0213106 | A1 | 11/2003 | Ichikawa et al. | |
| 2003/0231809 | A1 | 12/2003 | Bentsen | |
| 2006/0075612 | A1 | 4/2006 | Wu | |
| 2006/0236510 | A1 | 10/2006 | Kusayama et al. | |
| 2007/0067969 | A1 | 3/2007 | Kusayama et al. | |
| 2007/0226965 | A1 | 10/2007 | Cossutti | |
| 2007/0245529 | A1 | 10/2007 | Stewart | |
| 2007/0266532 | A1 | 11/2007 | Katada et al. | |
| 2009/0019675 | A1 | 1/2009 | Peano | |
| 2009/0307880 | A1 | 12/2009 | Brightman | |
| 2011/0126383 | A1 | 6/2011 | Takazawa et al. | |
| 2012/0311785 | A1 | 12/2012 | Goldberg | |
| 2013/0074293 | A1 | 3/2013 | Mikuma | |
| 2013/0287322 | A1 | 10/2013 | Gong | |
| 2014/0366336 | A1 | 12/2014 | Chung | |
| 2015/0374074 | A1 | 12/2015 | Martinson et al. | |

FOREIGN PATENT DOCUMENTS

| | | | |
|---|---|---|---|
| CN | 101380160 | A | 3/2009 |
| CN | 102917614 | A | 2/2013 |
| CN | 203735601 | U | 7/2014 |
| CN | 105120702 | A | 12/2015 |
| CN | 107105832 | A | 9/2021 |
| EP | 1714575 | A1 | 10/2006 |
| JP | 2627832 | B2 | 7/1997 |
| JP | 2006-102068 | | 4/2006 |
| JP | 2006-296732 | | 11/2006 |
| JP | 2007089898 | A | 4/2007 |
| JP | 2016-505343 | | 2/2016 |
| JP | 2003129315 | | 5/2023 |
| WO | WO 9909854 | A1 | 3/1999 |
| WO | WO 02/03824 | A1 | 1/2002 |
| WO | WO 02/102181 | A1 | 12/2002 |

OTHER PUBLICATIONS

Office Action dated Oct. 24, 2017 issued in parallel Japanese Patent App. No. 2017-529707 (8 pages).
Supplementary European Search Report and Search Opinion dated Sep. 26, 2018 issued in related European Patent App. No. 15865178.6 (6 pages).
Office Action dated Apr. 10, 2019 issued in parallel Chinese Patent App. No. 201580072320.0 (12 pages).
PCT Search Report issued in related PCT App. No. PCT/US2015/063451 dated Feb. 23, 2016 (3 pages).
International Preliminary Examination Report on Patentability and Written Opinion issued in related PCT App. No. PCT/US2015/063451 dated Feb. 23, 2016 (6 pages).
Extended European Search Report dated Feb. 4, 2020 issued in related European Patent App. No. 19208372.3 (8 pages).
International Search Report and Written Opinion dated Jul. 29, 2019 issued in related PCT App. No. PCT/US2019/032518 (10 pages).
Office Action dated Oct. 25, 2022 issued in related Japanese App. No. 2021-531219.
Office Action dated Jul. 13, 2023 issued in related Japanese App. No. 2021-531219 (5 pages).
Office Action issued on Dec. 29, 2023 in parallel Chinese patent application No. 201980081014.1with ENG translation. (13 pages).

* cited by examiner

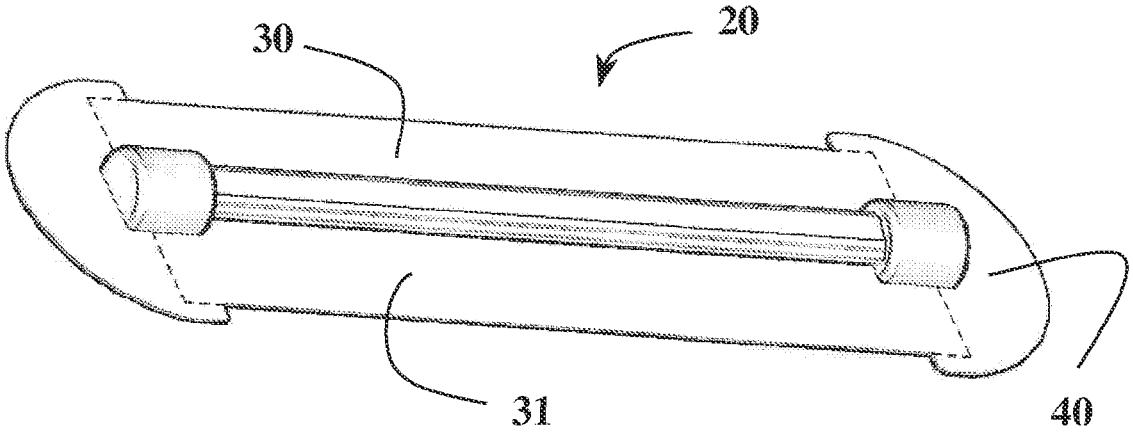
FIG. 22
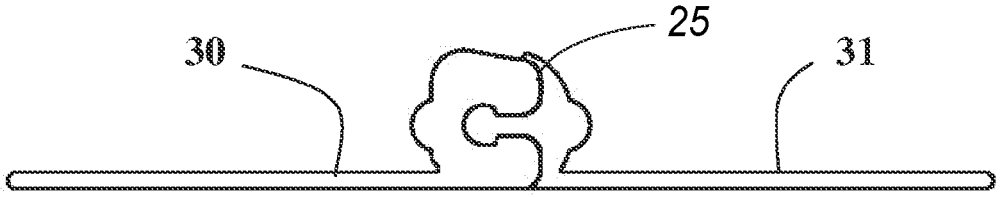
FIG. 23
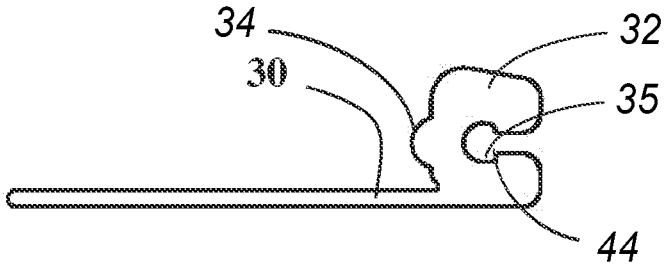
FIG. 24
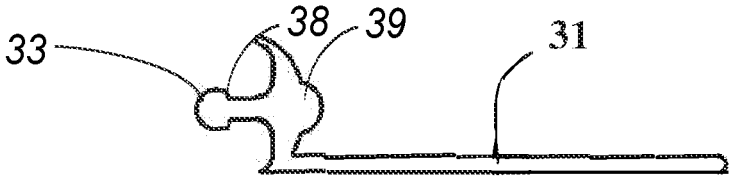

SYSTEMS AND METHODS FOR EXTRUDED ZIPPERS, ZIPPER GARAGES, CONNECTION TECHNIQUES, AND USES THEREFORE

CROSS REFERENCE TO RELATED APPLICATIONS

This application is a continuation of co-pending U. S. patent application Ser. No. 16/278,550, filed Feb. 18, 2019; U.S. patent application Ser. No. 16/278,548, filed Feb. 18, 2019; U.S. Pat. No. 11,109,650 granted Sep. 7, 2021; U.S. Pat. No. 11,006,702 granted May 18, 2021; International Application No. PCT/US2015/063451 filed Dec. 2, 2015 and U.S. Provisional Application No. 62/087,687 filed Dec. 4, 2014, which are incorporated herein by reference in their entirety.

BACKGROUND

A weak point in many zippers that are intended to be waterproof is at the final closure point of the zipper. In many zipper configurations, a small but significant aperture will exist at the zipper closure point. Depending on the performance required by the waterproof nature of the zipper, even such a small aperture is unacceptable.

Most, if not all, polymer zipper systems are made from Olefin-based polymers like polypropylene or polyethylene. Polymer zipper profiles are manufactured using an extrusion process. Olefin-based systems are prevalent in many polymer zipper systems due to the inherent low cost of the polymer resin and its low coefficient of friction properties. A low coefficient of friction is important so that the ball and socket of the zipper can be pushed together with minimal effort. However, Olefin-based zipper systems have their limitations. Most Olefin-based zipper systems made from polypropylene and polyethylene are not durable when used in exterior environments where temperature extremes affect the performance of the material. Polypropylene and polyethylene zipper profiles lack tensile and tear strength and good elongation properties. They also have excessive compression set when exposed to stress loads at higher temperatures. Therefore, they are not used for extreme applications such as "drybags" and "wet-suits" that are often used in hot environments. Rather, they are used for sandwich bags and other low performance applications.

SUMMARY

In one embodiment, a zipper system includes a zipper having a male and female side. In some configurations, the zipper system includes a slider. In some configurations, the zipper includes a slider garage. In some configurations, the zipper system has one or more open ends. In other configurations, the zipper system has one or more closed ends. In some configurations, the zipper is deployed in an article of clothing. In many cases when deployed in clothing, the zipper system includes at least one slider garage for securing the slider. In many cases when deployed in clothing, the zipper system may be used to close pockets, jackets, pants, shirts, zip-off portions. In some configurations, the zipper system may be deployed in bags of various types, such as cooler bags, wallets, bike pouches, food bags, dry bags, and a wide variety of other bags. Additionally, the zipper system may be deployed in inflatable objects. In some configurations, tubes may be interconnected via a zipper system. Alternatively, air-valves used for filling inflatables may be additionally sealed by a zipper system. Additionally, the zipper system may be used to provide waterproof document protection to pouches, safes, sleeves, and other enclosures. In some configurations, the zipper system may be used to seal rooms, for activities such as surgery or hazardous materials/biologicals or other uses. The zipper system may be used to connect items or as a safety release that releases under sufficient tension.

In one embodiment, the zipper system includes a male side and a female side of the zipper. In some configurations, the zipper system has a slider. In some configurations, the zipper system has a slider garage at one end. In some configurations, the zipper system has a slider garage at both ends. In some configurations, one or more ends of the zipper system are closed. In some configurations, one or more ends of the zipper are open. In some configurations, there is a double slider garage. In some configurations, the zipper system includes a double slider. In some configurations, both ends are open.

In many configurations, the slider garage is an innovative feature. In one embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion and the overmolded body is molded over a portion of the zipper. Alternatively, the zipper includes a male side and a female side, and the overmolded male portion is positioned on the male side of the zipper and the overmolded female portion is positioned on the female side of the zipper. In one alternative, the overmolded body forms a u-shape and the overmolded male portion and the overmolded female portion are part of the u-shape. In another alternative, the overmolded male portion and the overmolded female portion are on the interior of the overmolded body where a first and second side of the overmolded body meet when a slider is engaged in the slider garage. Alternatively, the zipper interfaces with the overmolded body without interruption. In another alternative, the zipper includes a continuous top edge. Alternatively, a flange of the zipper is not exposed between the zipper and the overmolded body. In another alternative, there is no break in the zipper along a length of the zipper assembly. Alternatively, there is no break between the zipper and the slider garage along the length of the zipper assembly.

In one embodiment, a slider garage includes an overmolded body, the overmolded body located on an end of a zipper, the overmolded body providing a waterproof seal when engaged with a slider, wherein the overmolded body is molded over a portion of the zipper. In one alternative, the overmolded body forms a u-shape and an overmolded male portion and an overmolded female portion are part of the u-shape. In another alternative, the overmolded male portion and the overmolded female portion are on the interior of the overmolded body where a first and second side of the overmolded body meet when a slider is engaged in the slider garage. Alternatively, the zipper interfaces with the overmolded body without interruption. In another alternative, the zipper includes a continuous top edge. Alternatively, a flange of the zipper is not exposed between the zipper and the overmolded body. In another alternative, there is no break in the zipper in the along a length of the zipper assembly. Alternatively, there is no break between the zipper and the slider garage along the length of the zipper assembly.

In one embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion, wherein the overmolded body is molded over a portion of the zipper. Alternatively, the zipper includes a male side and a female side, and the overmolded male portion is positioned on the male side of the zipper and the overmolded female portion is positioned on the female side of the zipper. In one alternative, the overmolded body forms a u-shape and the overmolded male portion and the overmolded female portion are part of the u-shape. In another alternative, the overmolded male portion and the overmolded female portion are on the interior of the overmolded body where a first and second side of the overmolded body meet when a slider is engaged in the slider garage.

In one embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion. Optionally, the zipper includes a male side and a female side, and the overmolded male portion is positioned on the male side of the zipper and the overmolded female portion is positioned on the female side of the zipper. Alternatively, the slider garage further includes an inner wall in the overmolded body, wherein the inner wall is sized to have a height that causes the inner wall to seal against a slider when it is advanced to an end of the slider garage distal from the zipper. Optionally, the inner wall includes an incline portion, such that the incline portion forms a ramp for the slider to gradually seal against the inner wall. In one configuration, the inner wall of the slider garage includes a portion distal from the zipper, the portion distal from the zipper having an approximate u-shape and the inner wall of the slider garage includes a zig-zag shaped portion, the zig-zag shaped portion having a first portion on a male side of the zipper which is the side including the overmolded male portion and a second portion on a female side of the zipper which is the side including the overmolded female portion, an end of the zig-zag shaped portion proximate to the zipper having a first position and a second position, the first position characterized by the first portion on the male side of the zipper being immediately adjacent to the second portion on the female side of the zipper when the slider is engaged in the slider garage and the second position characterized by the first portion on the male side of the zipper being away from the second portion on the female side of the zipper when the slider is not engaged in the slider garage, and the first and second portions include the incline portion. Optionally, the overmolded female portion and the overmolded male portion have a first position and a second position, the first position characterized by the overmolded female portion and the overmolded male portion not being engaged, and the second position characterized by the overmolded female portion and the overmolded male portion being engaged. Alternatively, the shape and positioning of the overmolded female portion and the overmolded male portion cause the overmolded female portion to be pushed vertically upward and the overmolded male portion to be pushed vertically downward when the overmolded female portion and the overmolded male portion have a first position and a second position and are in the second position. Optionally, the inner wall is surrounded by a side wall, and the side wall is interconnected with the inner wall via a plurality of supports. Alternatively, the overmolded body includes a transition line wherein the transition line defines the line which the slider must pass to complete a seal of the zipper and slider garage. In one alternative, the transition line is approximately in line with the male and female overmolded portions. In another alternative, a first portion of the zipper on a first side where the overmolded male portion is located extends further into the overmolded body than a second portion of the zipper on a second side where the overmolded female portion is located. Optionally, the overmolded body is made of thermoplastic polyurethane. In another alternative, the overmolded body has a durometer between 60 and 90 shore A. Alternatively, the overmolded body portion is textured to reduce adhesion. Optionally, the thermoplastic polyurethane includes a slip agent.

In another embodiment, a slider garage includes an overmolded body, the overmolded body located on an end of a zipper, the overmolded body providing a waterproof seal when engaged with a slider. Optionally, the overmolded body includes a male overmolded portion and a female overmolded portion, wherein the male overmolded portion fits into the female overmolded portion to form the waterproof seal when engaged with the slider. Alternatively, a height of the overmolded body is such that the overmolded body seals against the slider when the slider engages the overmolded body. Optionally, the overmolded body includes a ramp to ease the transition from a sealed to a non-sealed state. Alternatively, the overmolded body is made of thermoplastic polyurethane. In one alternative, the overmolded body has a durometer between 60 and 90 shore A.

In another embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion. The overmolded female portion and the overmolded male portion have a first position and a second position, the first position characterized by the overmolded female portion and the overmolded male portion not being engaged, and the second position characterized by the overmolded female portion and the overmolded male portion being engaged. Optionally, the shape and positioning of the overmolded female portion and the overmolded male portion cause the overmolded female portion to be pushed vertically upward, the overmolded male portion to be pushed vertically downward when the overmolded female portion and the overmolded male portion have a first position and a second position and are in the second position. Alternatively, the slider garage further includes an inner wall in the overmolded body, wherein the inner wall is sized to have a height that causes the inner wall to seal against a slider when it is advanced to an end of the slider garage distal from the zipper. Alternatively, the inner wall includes an incline portion, such that the incline portion forms a ramp for the slider to gradually seal against the inner wall.

BRIEF DESCRIPTION OF THE DRAWINGS

FIG. 22 shows an alternative embodiment of a zipper system;

FIG. 23 shows a cross-section of the zipper system of FIG. 22;

FIG. 24 shows a cross-section of the zipper system of FIG. 22 separated;

DETAILED DESCRIPTION OF THE DRAWINGS

Figure 1:
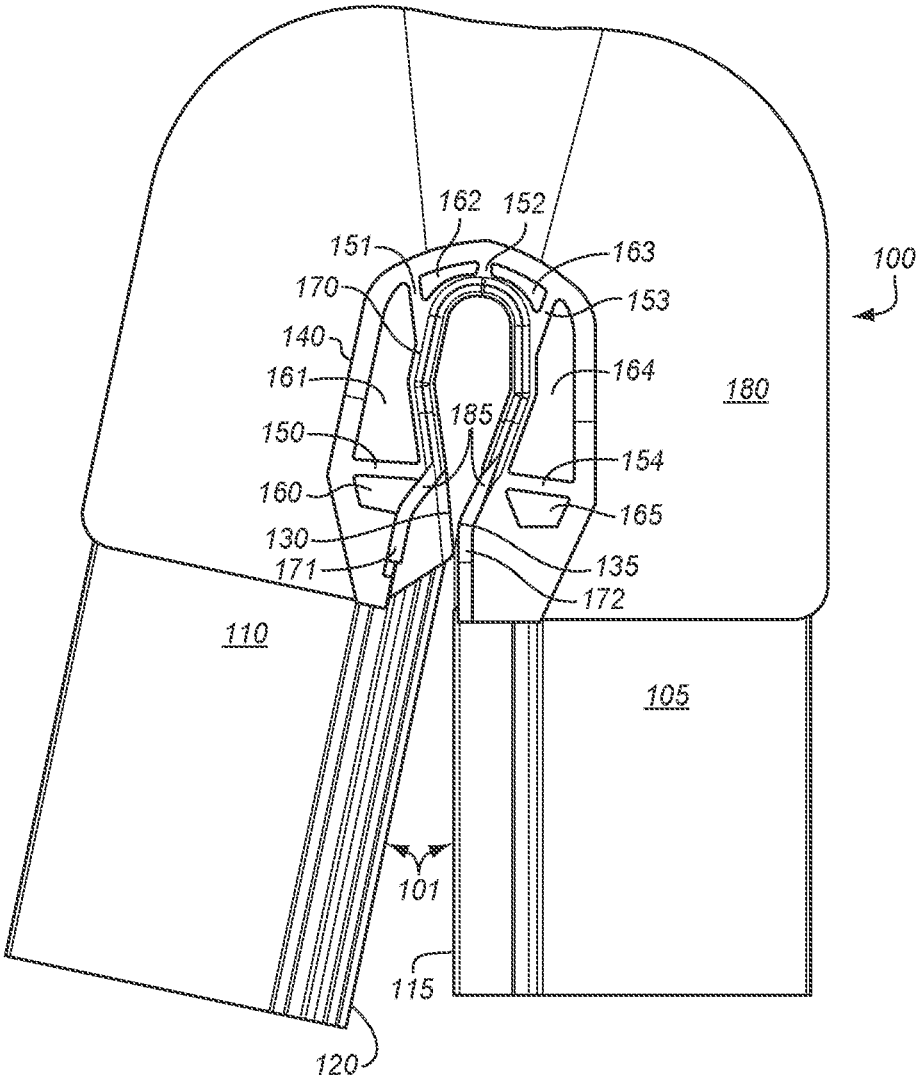
FIG. 1 shows a top view of one embodiment of a slider garage and zipper.

Described herein are embodiments of an improved zipper slider garage (referred to as "slider garage" at times) and methods of using it and making it as well as a variety of zipper systems that may be employed in a variety of configurations. Generally, but not exclusively, the term "zipper system" as used herein, includes any of a zipper having a male and female side with a ball in socket connection system, a zipper having a male and female side with a ball in socket connection system including a slider, zipper having a male and female side with a ball in socket connection system including a slider and a slider garage, and a zipper including a slider garage, the slider garage having a male and female side for sealing the garage. Of the many advantageous aspects of the improved zipper slider garage, the slider garage includes a shape that provides for an interference fit between the slider of the zipper (or referred as "zipper assembly") and the slider garage. This interference fit provides for a seal at the end of the zipper making the zipper waterproof. Although this is a feature that makes the slider garage waterproof, there are many additional features that serve to make the slider garage function in a user friendly and optimal fashion. These features include the male side of the zipper extends further into the slider garage than the female side, the sliding lock mechanism of the zipper, the material of the zipper and the slider garage, and the flexible design of the slider garage. In many embodiments, zipper systems described are waterproof and may be airtight. In many embodiments and alternatives, various pieces of the zipper and slider garage may be used alone, or in combination with other elements described herein. Additionally, these embodiments and alternatives may be incorporated into any device, clothing, or structure as further discussed below.

This forms the basis for many different embodiments of zippers, zipper slider garages, and items including waterproof zippers. In many embodiments, the zipper takes a basic form of a ball in socket. Essentially, the ball is received by the socket of the zipper and is held in a place by flexing the socket. Additionally, the socket may include an air pocket which assists in holding the socket in place. In many embodiments, the slider garage may be molded over the end of the zipper. The zipper in many configurations includes a slider that causes the ball portion of the socket to be pressed into the socket portion. The slider may be designed to mate with the slider garage. In many configurations, the slider garage may include an interior protrusion that fits into a female receiver in the slider garage itself. The ability to mold over the existing zipper male and female side with a slider garage having a corresponding male and female side is advantageous and assists with sealing off the zipper. In many configurations, the zipper is attached via a flange, the flange being heat welded, glued, or otherwise attached to another body. At times, each side of the zipper (either the male or female portion) may be referred to as a side of the zipper. The zipper, the ball-in-socket arrangement, the flange, and the zipper garage may be implemented alone or in combination with the other parts described herein.

Many materials may be utilized to create the zipper, the slider, and the slider garage and any parts of the systems described herein. The materials described may be used alone for these portions or in combination, without limitation. Possible materials include, but are not limited to, TPE, Silicone, Elastomers, PET polyethylene terephthalate, Neoprene, Nitrile Rubber, Butyl Rubber, Recycled Content, TPU, Nylon (fabric and plastic), Polyester, EPTFE/Gortex, Cotton, Canvas, EVA Foam, Polyurethane, Polyethylene, Polycarbonate, Polypropylene, ABS (Acetyl Butyl Styrene), Polystyrene, EPDM Rubber, PVC, Vinyl, Tyvek®, Tychem®, Kevlar®, Nomex®, Aluminum, Steel/Stainless Steel, and Wood, and any other material that will occur to one of ordinary skill in the art. These materials, for instance may merely form a portion of the slider or may form a portion of one of the sides of the zipper (for instance, the rail portion may be formed of wood and the ball and socket portion formed of TPE.

The zippers, sliders, and slider garages (collectively zipper system(s)), may be deployed in a wide variety of contexts. The zipper systems may be deployed anywhere on clothing, including gloves, footwear, and headwear. For instance, zipper systems may be used on pockets on clothing, closures on clothing, vents on clothing, identification pockets on clothing, zip-off pants legs on convertible clothing (or breakaway clothing), zip-off sleeves on convertible clothing (or breakaway clothing), zip-off gloves on clothing (or breakaway clothing), zip-off feet coverings on clothing, zip-off hoods or other head coverings, personal protection/hazardous material protective clothing, military/tactical clothing and equipment, fishing waders, or footwear zipper. Essentially, any closure or attachment point on clothing may incorporate a zipper system.

Additionally, the zipper system may be deployed variety of bags and enclosures including, but not limited to, cooler bags, backpacks, packs, suitcases/travel bags, suitcase/packing pouches, toiletry bags/makeup bags, wallets, pouches, phone cases/pouches, food bags (reusable food/freezer bags, food bags with a vacuum evacuation tube, ice bags/packs, pocket flask, hydration pack/bag), tool bag, trash/animal refuse bag, emergency/first aid kit, dry bags (for weapons (rifles, handguns, ammunition)), body bags, rooftop bags for vehicles, ski and snowboard bags, avalanche pack (where the rails intentionally separate to deploy the airbag), panniers for bicycles, motorcycles, and scooters.

Additionally, the zipper system may be deployed in inflatable objects. This includes, but is not limited to, bouncing houses and other pressurized playhouses, balls, mats, sleeping maps, inflatable furniture, ice packs, heat packs, and other objects. The zipper system may be deployed over inflation areas that may include other valves to provide additional sealing. Additionally, the zipper system may be utilized as the sealing system itself. The zipper system may also be used in inflatable tent tubes.

The zipper system lends itself to use in document and electronic document protection. The zipper system may be used in zipper document pouches for instructions, school work, legal documents, and other documents. The zipper system may be used in the waterproofing of safes by putting a zipper sealable membrane inside or outside of the safe. The zipper system may be used in a laptop sleeve or with a shroud for equipment protection.

In many embodiments, the zipper is attached via flanges to another object, such as a pouch/bag, clothing, or other object. Alternatively, the zipper may be directly attached via the zipper sides. A side variety of techniques may be used to connect the zipper, either by the flanges or otherwise. Techniques include, heat welding, glue, extrude over the object to be bound to, sewn, heat seal/tape-heat activated glue, radio frequency or high frequency welding (separate from heat welding), insert molded/inset, or any combination of the above.

The zipper system may even be used in the closure of rooms. The zipper system may provide airtight seals for surgery, diseases, hazardous materials, clean rooms, hyperbaric chambers, etc. Because the zipper system provides an airtight seal, when coupled with other airtight materials, sealed rooms or areas may be achieved. The zipper system may be deployed on a tent (for any place on a tent body, including, but not limited to: body, fly, single wall, removable floor, etc.), especially including areas needing water proofing. The zipper system may be deployed in a bivy sack, a portaledge, and access point to an area containing sensitive equipment that needs protection from the elements or that may need periodic inspection or maintenance.

In some configurations, the zipper system is used to connect items. In some configurations, the zipper system may be used to connect a plurality of tubes. Each end of a tube may include a zipper system, so that numerous tubes may be interconnected. In such a configuration, a long tube may be easily created of the desired length may be created. Additionally, the connection of items may include the connection of molded plastic parts (e.g. separators in a cooler). Additionally, the zipper system may be used in removable panels.

In some configurations, the zipper system may be used in safety release systems. For instance, if a small portion of a zipper is used, then the zipper may serve as a quick release that will release under a sufficient force, as the socket is deformed to release the ball portion.

In many embodiments, the zipper system may have a variety of different ends at the termination points of the zipper. Types of ends may include a zipper garage as described in many places herein. The zipper system may have a garage at either end of the device. Additionally, the zipper system may include a closed end, such that the end is welded or otherwise connected together but does not include a garage. In some configurations, the end may be left open, such that the slider may be slid off of the end. In other configurations, one half of the zipper may extend beyond the other side and may be stopped or closed, such that the zipper may be slid beyond one rail but not the other and re-interfaced with the non-stopped rail. In some embodiments, the slider garage may be a double-sided garage, such that the garage may receive a slider on either side. Additionally, in some embodiments the zipper system may include two sliders that each slide towards a slider garage at opposing sides of the zipper system (or alternatively, there may be only one garages or no garages). In some embodiments, both sides of the zipper are open, in that there is no slider garage or stop at either end of the zipper. In some configurations, the slider itself may have a garage on an opposing side of the slider that may receive another slider in a two-slider configuration. All of these configurations described herein may be implemented in any of the deployments described, such as bags, clothing, etc., as described above. Also, the entirety of the flange/zipper/slider garage combination need not be implemented; any one piece can be implemented.

FIG. 1 shows one embodiment of a slider garage 100. In some configurations, the slider garage 100 is an overmolded extrusion. Slider garage 100 is overmolded onto a waterproof zipper 101 that includes male side 120 and female side 115. Male side 120 and female side 115 of zipper 101 each include flanges 110, 105 that are used to attach the zipper 101 to a bag or other object. In operation, the sides of zipper 101 come together and close the bag or other object. In practice, the very end of zipper 101 where the slider would rest may not be completely waterproof and may be prone to opening if the slider garage 100 was not utilized. In different configurations, these materials may be used in isolation or combined, and may make up a portion of each piece of the device or the entirety of each piece of the device. As described herein, this zipper may be deployed in a wide variety of contexts. Although shown with a slider garage, the device need not include a slider garage and may take a variety of other end forms.

Figure 6:
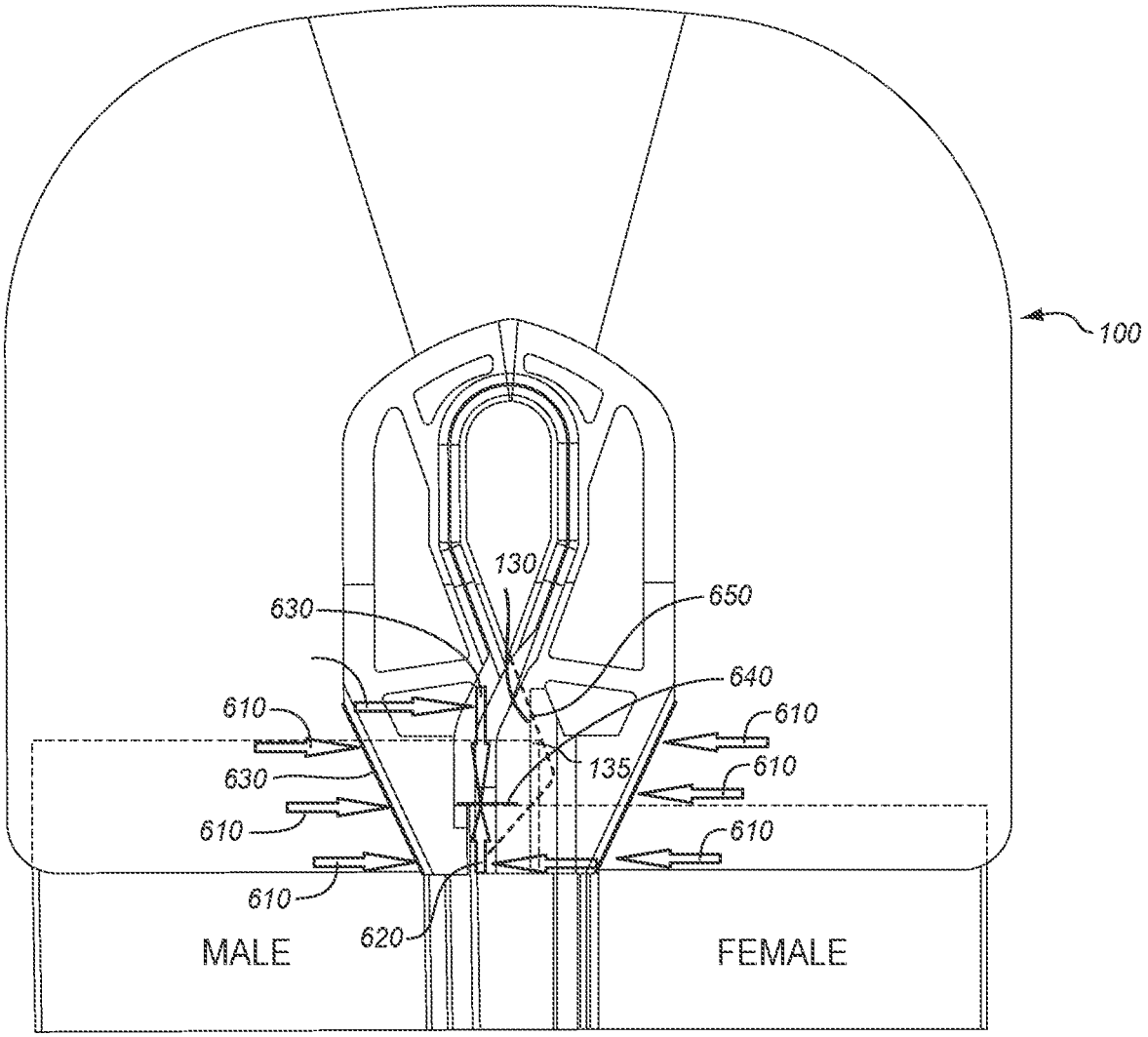
FIG. 6 show various pressures exerted during the engagement of the slider with the slider garage of FIG. 1.

Many aspects of the slider garage 100 are visible in FIG. 1. Slider garage 100 includes an overmolded male portion 130 and an overmolded female portion 135. The overmolded male portion 130 and overmolded female portion 135 cooperate to ensure a waterproof seal is formed (in the transition) between the slider garage 100, the male side 120, and the female side 115 of zipper 101 when fully engaged by the slider (the slider is not shown here). As the slider engages the slider garage 100, it applies sideways inward pressure that pushes overmolded male portion 130 and overmolded female portion 135 together horizontally. Simultaneously, this inward pressure pushes the overmolded female portion 135 vertically upward, and because of the overmolded male portion's 130 shape and the overmolded female portion's 135 reciprocal overmolded shape, this inward pressure pushes the overmolded male portion 130 vertically downward where the two parts meet and engage in a locked sealing position. FIG. 6 depicts this sealing position. The locked sealing position compresses the overmolded male portion 130, forming a tight seal. Although this slider garage is deployed for a zipper having a male and a female portion, many other configurations are possible. The slider garage can be deployed with any type of zipper.

FIG. 1 also shows the side wall 140, supports 150, 151, 152, 153, 154, voids 160-165, and inner wall 170 of the slider garage 100. Inner wall 170 also includes incline portions 171, 172. Finally, slider garage 100 also includes flange 180 that provides for flexibility and sealing to the bag or other item. Various embodiments of the slider garage 100 may not include some of these aspects and may still function; although, in many embodiments, the incline portions 171, 172 are used for sealing. In order for optimal functioning, it is important to maintain a slider garage that has a balance of stiffness and flexibility. This balance enables smooth operation of the slider on zipper 101 and slider garage 100.

When broken down to the simple components that seal the zipper 101, transition point 185 is important to recognize. As a slider moves down zipper 101 and begins to engage slider garage 100, the inner portion of the slider begins to engage the incline portions 171, 172. After the down facing inner portion of the slider passes transition point 185, the waterproof seal is formed. The seal may form for a number of reasons including, but not limited to, the engagement of the male and female overmolded portions and the engagement of the slider with the slider garage. This might be accomplished without incline portions 171, 172; and slider garage 100 might have a hard transition, in some alternatives, at point 185, from providing no contact and/or interference with the down facing inner portion of the slider to an amount of interference that seals the zipper 101 and slider garage 100. As can be discerned, the slider would be difficult to operate in such a scenario, since the slider and the slider garage 100 would have to flex significantly over a short distance. This would require a lot of force from the user. Therefore, a first aspect of the innovation in the slider garage 100 is that the slider seals against inner wall 170, making the closure waterproof. Another innovation is that incline portions 171, 172 make the transition of the slider into a sealed position gradual, utilizing the wedge that incline portions 171, 172 provide. Pulling the slider towards the wedge provides an upward force approximately perpendicular to the movement of the slider. The aspect of incline portions 171, 172 make the zipper 101 easier to operate.

In some configurations, even with the inclusion of incline portions 171, 172, the zipper may still be difficult to operate. In order to have a strong seal, inner wall 170 must be rigid enough to avoid flexing in such a way to break the seal between the slider and the inner wall 170. In order to accomplish this, inner wall 170 may be thickened or made of stiffer material. Although this ensures a seal, engaging and disengaging a slider from slider garage 100 may be more difficult due to the lack of give and flex. In order to enable a thinner and more flexible inner wall 170, side wall 140, supports 150, 151, 152, 153, 154, and voids 160-165 have been included in many embodiments. These side walls 140, supports 150, 151, 152, 153, 154, and voids 160-165 provide for both flexibility of slider garage 100 and stiffness to resist unwanted release of the seal between the slider and slider garage 100.

Note that supports 150, 154 approximately coincide with transition point 185. This is an important location on slider garage 100. Since transition point 185 is the primary point where seal is achieved, this point in many configurations is optimized by including supports 150, 154 at the same point. Therefore, slider garage 100 is prevented from flexing greatly at this point, while at the same time more flex is enabled before and after the transition point 185 by voids 160, 161, 164, 165. The other supports and voids function in a similar fashion to enable flexion and support. Similarly, flange 180 may assist in providing give and flexion to the entire device.

In addition to the structure of slider garage 100, the material that is used is optimized as well. Typically, zipper 101, the slider, and slider garage 100 are composed of TPU (Thermoplastic polyurethane). Unlike Olefin-based plastics, TPUs are crosslinked polymer elastomers that exhibit rubber-like properties at high and low durometers. TPU polymers exhibit extremely high tensile and tear strengths and high elongation properties at high and low temperature extremes. TPU polymers also exhibit superior compression set resistance. TPU polymers are designed for use in extreme outdoor applications. In sealing applications, such as slider garage parts, relatively low durometer material is used because of its excellent sealing properties that include being soft/malleable and tacky/being able to stick to itself. The side effect of these excellent sealing properties is that they also tend to be tacky and "stick" to other materials on contact. In a slider garage application, because of the interference fit between the slider and slider garage 100, this effect is amplified, making the slider somewhat problematic to fully engage and disengage slider garage 100. As a solution in some alternatives, slider garage 100 is made of a compounded material. The compound consists of a 75 A durometer TPU material and a slip agent. This specific combination of materials produces a part that retains excellent sealing properties and at the same time allows the slider to easily engage and disengage slider garage 100. Additionally, in alternatives, the TPU material may be textured. Light regular and irregular textures may be applied to the TPU material. These textures are typically between 0.01 millimeters and 1 millimeter in depth, size, and spacing, where the arrangement may be a combination of different depths, sizes, and spacing as well. Typically, these textures are less than 0.1 millimeters in depth. The textured nature of the TPU may prevent the TPU from sticking or adhering to itself and may increase ease of use in sliding parts past each other.

Figure 2:
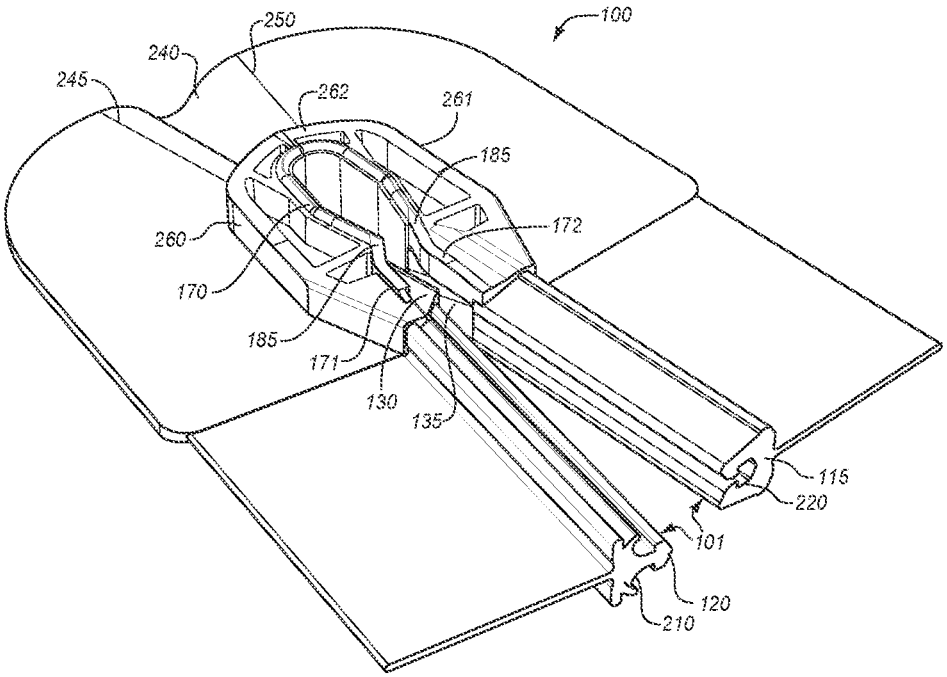
FIG. 2 shows a perspective view of the slider garage of FIG. 1.

FIG. 2 shows a perspective view of the slider garage. In this view, many aspects of zipper 101 and slider garage 100 are visible. The sloped nature of incline portions 171, 172 is visible in this view, as is the raised nature of inner wall 170. Also, the overmolded male portion 130 and overmolded female portion 135 are more clearly visible. Here it can be seen how the overmolded male portion 130 fits into the overmolded female portion 135 and effectively caps zipper 101 over the protruding ball portion 210 (see FIG. 3) of male side 120 that fits into the socket 115 of female side 220 (see FIG. 3). This helps to create a more effective seal. Slider garage 100, in many embodiments, is designed to work with a ball-in-socket type of zipper as shown in FIG. 2. In this type of zipper, ball portion 210 (see FIG. 3) of male side 120 is pressed into socket 220 (see FIG. 3) of female side 115. The male and female 120, 115 flex and slide in relation to each other to create this engagement, and certain pieces of zipper 101 may be made more or less flexible to provide for stiffness where needed and flexibility to provide for engagement. Slip coatings or materials embedded with slip coatings also may be utilized. Also, in this view, a portion 240 of flange 180 has been segmented such that it may more easily flex between flex lines 245, 250. These flex lines 245, 250 provide for flexion of flange 180 (see FIG. 3) in a more complementary place for the function of the zipper and tend to provide for flexion away from sides 260, 261 of slider garage 100 and provide flexion, instead, at end 262. This helps support the continued integrity of slider garage 100 and inner wall 170 of slider garage 100, which is important for waterproof sealing.

Figure 3:
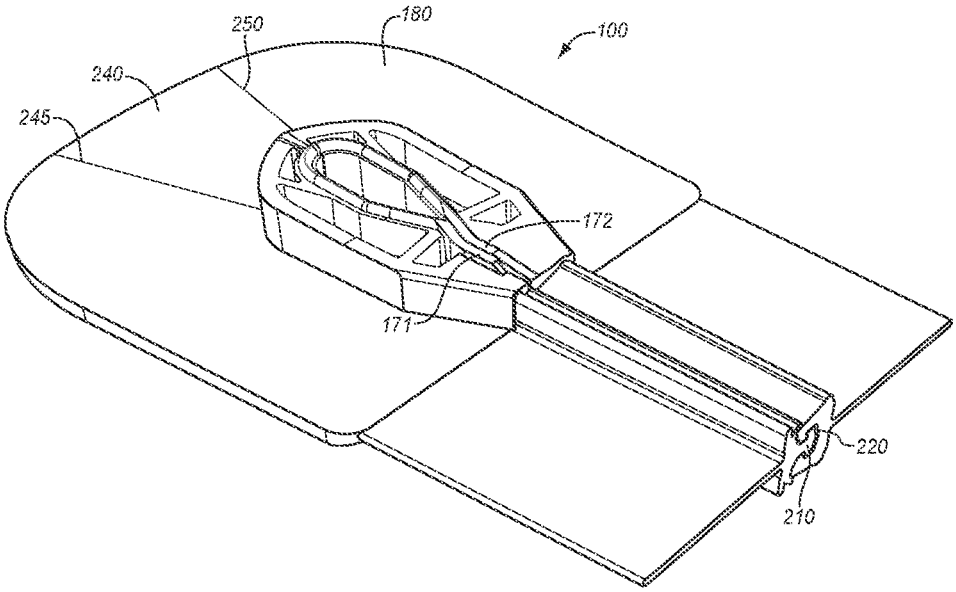
FIG. 3 shows a perspective view of the slider garage of FIG. 1 in a fully engaged position.

FIG. 3 shows a perspective view of slider garage 100 in a fully engaged position. In this position, incline portions 171, 172 have been pressed together tightly and the adhesive quality of slider garage 100 material will further provide for a tight fit and resistance to the penetration of water. Here it is clear how ball portion 210 engages socket 220 to close the main portion of zipper 101.

Figure 4:
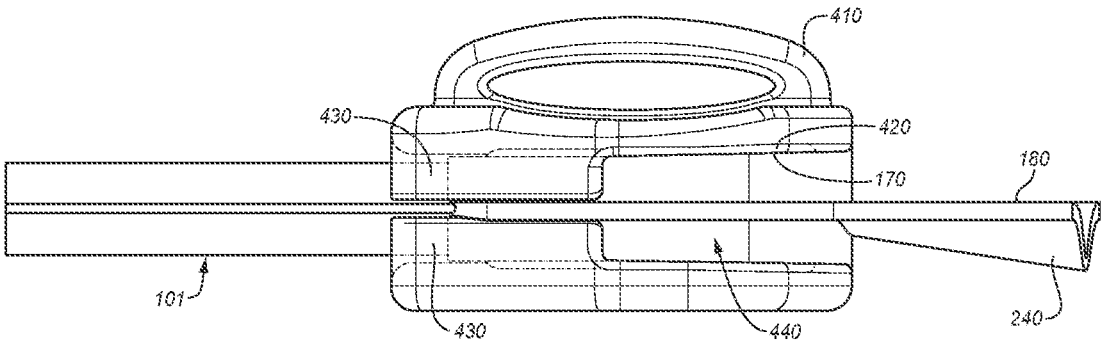
FIG. 4 shows a side view of the slider garage of FIG. 1 with a slider engaged.

FIG. 4 shows a side view of slider garage 100 with a slider 410 engaged. The inner wall 170 engages with the bottom inner surface 420 which is partially visible in the view provided. Slider side walls 430 and open area 440 of slider 410 function to gradually apply pressure to the side walls of slider garage 100 and assist in keeping a firm seal. Here it also is noted that the opposing side of slider garage 100 that is not shown in many of the figures also may be a raised inner wall that engages the upward facing inner surface of slider 410. This may be omitted in some embodiments, since the bottom of slider garage 100 is generally interior to the bag or other object that is intended to be waterproof.

Figure 5:
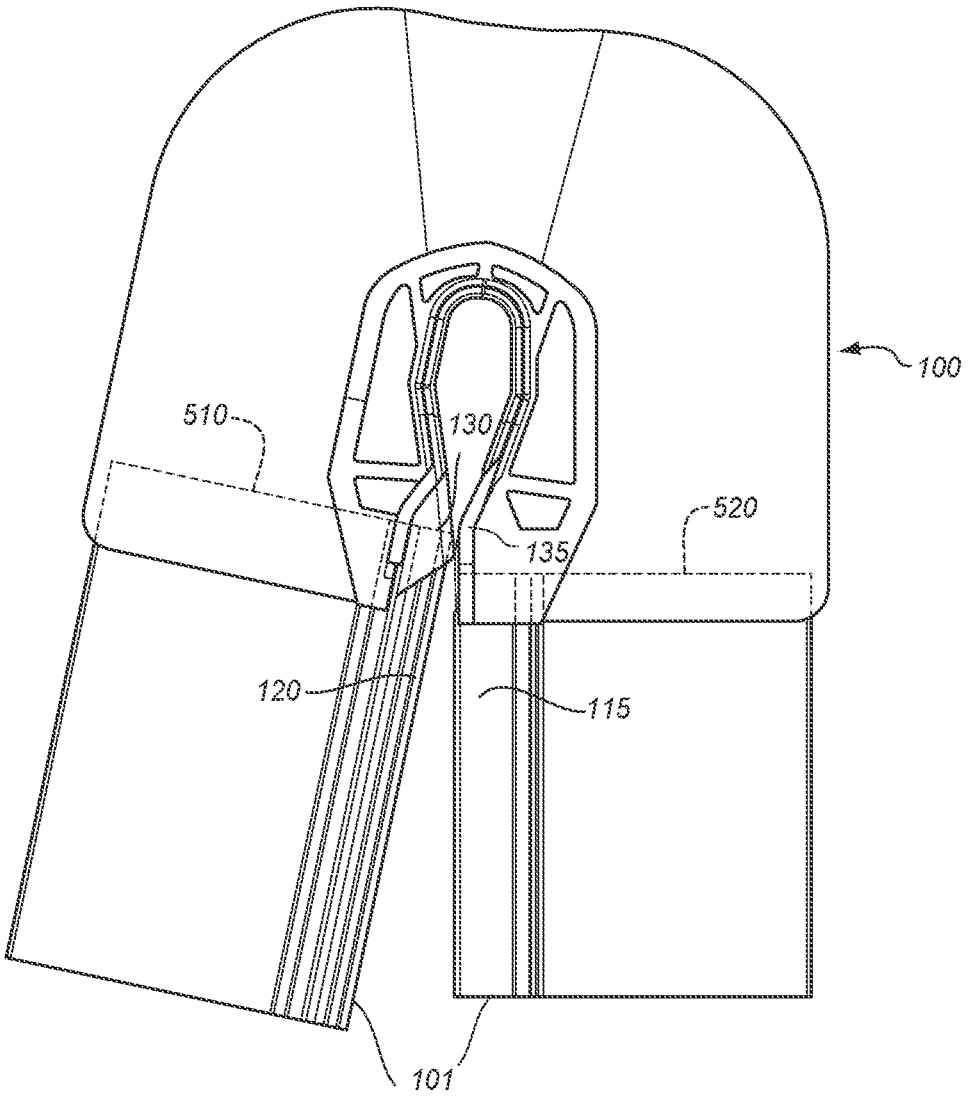
FIG. 5 shows a top view of the slider garage of FIG. 1.

FIG. 5 shows how the male side 120 of zipper 101 extends further to line 510 into slider garage 100 as opposed to the female side 115 which extends to line 520. This is optimal because, in order for overmolded female portion 135 to receive overmolded male portion 130 (visible in FIG. 2), female side 115 must terminate sooner than male side 120, since the void needed for overmolded female portion 135 (visible in FIG. 2) is deeper than that of female side 115 of zipper 101. Also, as is visible in this figure, slider garage 100 may extend farther down female side 115 without interfering with the operation of zipper 101.

FIG. 6 show various pressures exerted during the engagement of the slider with slider garage 100. As the slider advances toward the end of slider garage 100, the slider exerts an inward horizontal pressure 610 on the sides of slider garage 100. The horizontal pressure 620 of the slider pushes the overmolded male portion 130 (visible in FIG. 2) in a vertically downward direction 630 as it interacts with the overmolded female portion 135 (visible in FIG. 2). At line 640, the overmolded male portion 130 and the overmolded female portion 135 meet, with overmolded male portion 130 extending to line 650, and engage to create a locked sealing position that prevents water from passing the seal.

Figure 7:
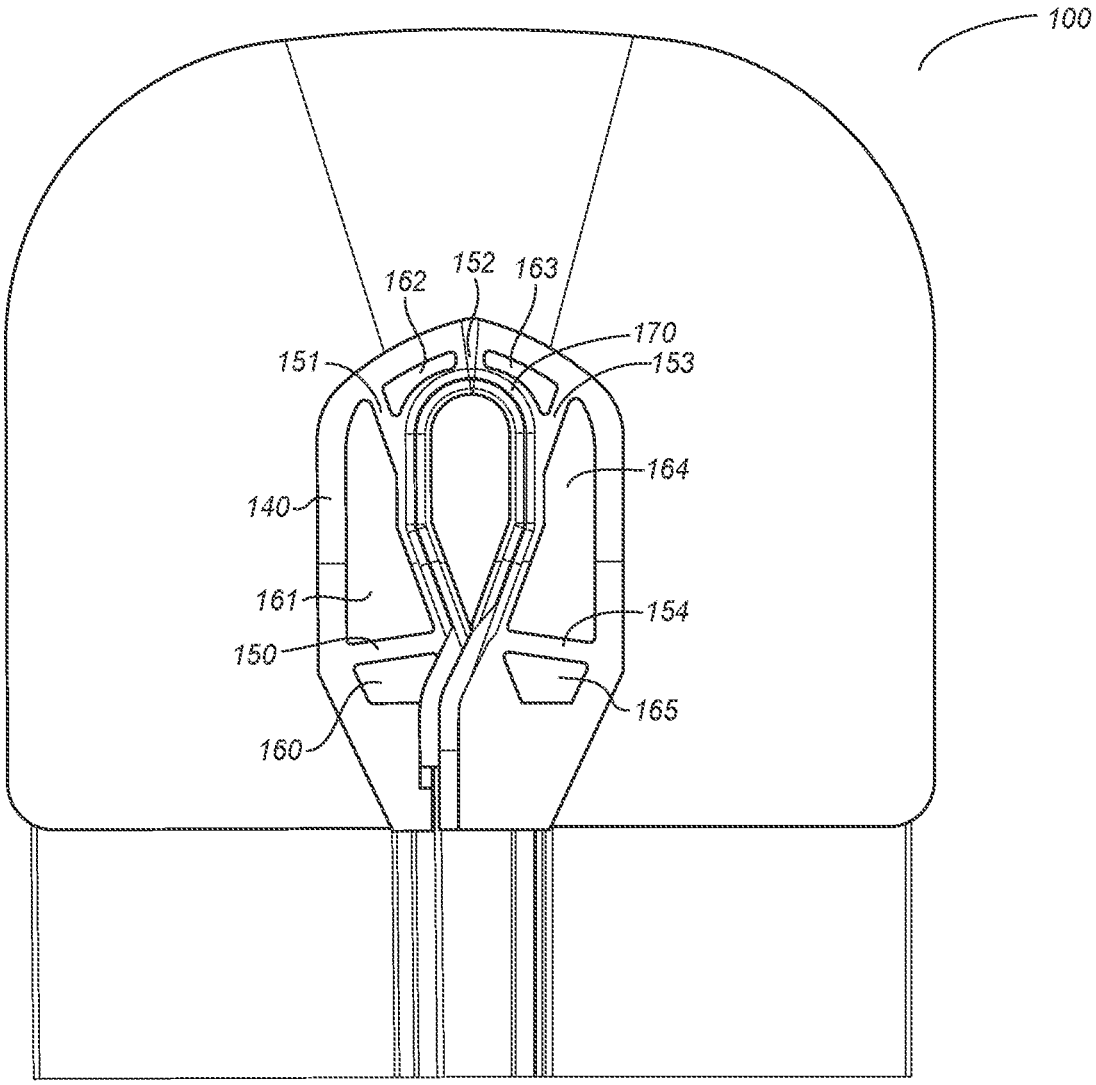
FIG. 7 shows an engaged view of the slider garage of FIG. 1.

FIG. 7 shows an engaged view of side wall 140, supports 150, 151, 152, 153, 154, voids 160-165, and inner wall 170 of slider garage 100.

Figure 8:
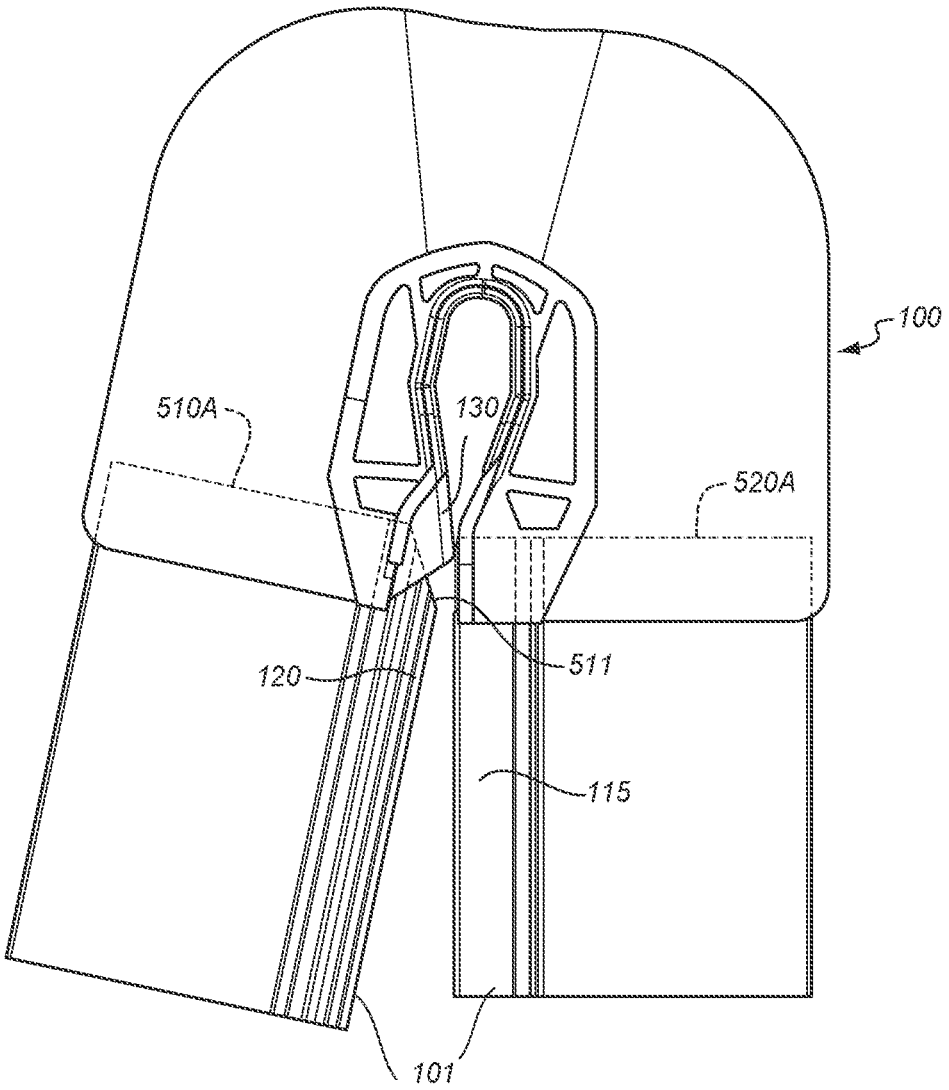
FIG. 8 shows another embodiment of a slider garage.

FIG. 8 shows another embodiment of how the male side 120 of zipper 101 extends to line 510A into slider garage 100 a similar or same distance to the female side 115 which extends to line 520A. Additionally, the male side 120 includes diagonal cut 511 which provides for the insertion of the overmolded male portion 130 (visible in FIG. 2). Without this diagonal cut, the male side 120 would interfere with the insertion of the overmolded male portion 130.

Figure 9A:
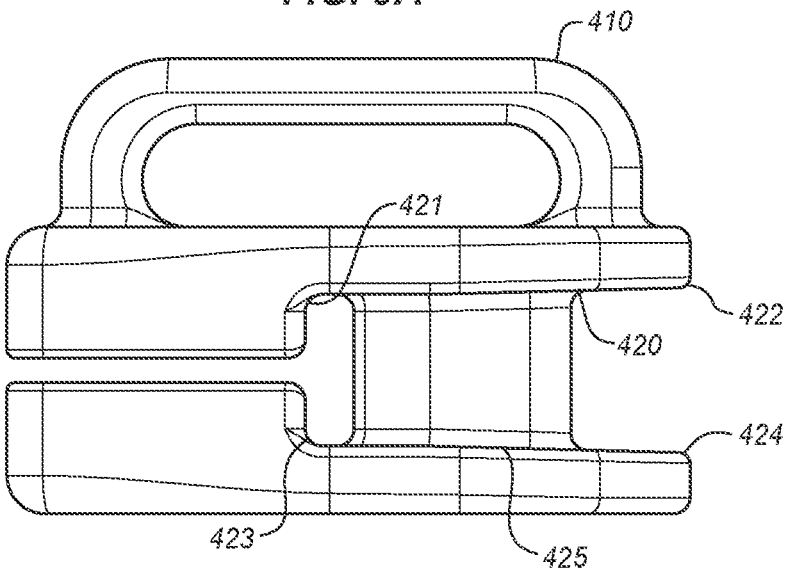
FIGS. 9A and 9B show a side view of the slider garage of FIG. 1 with a slider prior to engagement.
Figure 9B:
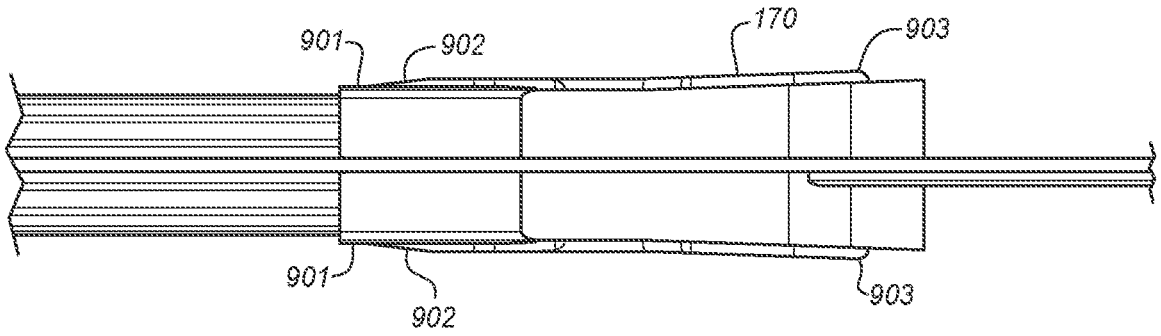

FIG. 9A shows side view of the slider 410. In this figure, the inclined nature of the interior portion of the slider 410 is visible. Bottom inner surface 420 is sloped from point 421 to point 422 and similarly sloped on inner surface 425 from point 423 to point 424. This results in the mouth of slider 410 being wider than the back end near points 421, 423. FIG. 9B additionally shows the slope of slider garage 100. Slider garage 100 includes a ramped portion from point 901 to point 902 where the slider 410 initially engages slider garage 100. Additionally, from point 902 to point 903, the thickness of the slider garage 100 gradually increases, providing for a water tight seal between inner wall 170 while engaged with the bottom inner surface 420 and inner surface 425. In principle, the slider garage and slider combination provides for an interference type seal as the slider is pressed against the slider garage. The resulting height of the slider garage is slightly less than the height of the slider when the two are fully engaged. The material of the slider and slider garage are flexible and deformable such that, as they move in respect to each other along their respective inclines, they may fully engage and form a seal.

In many embodiments, the interior of the zipper garage itself includes a male and female portion. This can be seen in FIG. 2 which shows how overmolded male portion 130 fits into the overmolded female portion 135. Additionally, it is apparent from the figures that there is no break in the continuity of the zipper from zipper portion itself to the garage. This is unlike other zipper systems with teeth that include a garage, the transition to the garage from the main zipper portion is seamless and smooth, increasing zipper usability. Additionally, as is visible in FIG. 6, the primary motion of the zipper, is merely that the male and female portions move towards and away from each other in a single plane. Many other toothless zippers that rely on hooks require movement in two planes of motion to engage and disengage. This is not so with the zipper shown. Similarly, the garage itself merely moves in a single plane to seal and unseal. In many embodiments, the slider garage includes a u-shaped portion having a male and female portion as part of the u-shaped portion. In many embodiments, the male and female portion that are part of the u-shaped portion are on the interior of the slider garage where the sides of the slider garage meet when the slider is engaged in the garage. In many embodiments, the zipper interfaces without interruption with the slider garage. In many embodiments, the zipper portion is continuous on a top edge of the device. In many embodiments, the flange is not exposed between the zipper and the slider garage. In many embodiments, there is no break in the zipper in the along the length of the zipper assembly. In many embodiments, there is no break between the zipper and the slider garage along the length of the zipper assembly. In many embodiments the zipper and the slider garage are immediately adjacent, such that they touch. In many embodiments, the slider garage is molded over a portion of the zipper.

Figure 10A:
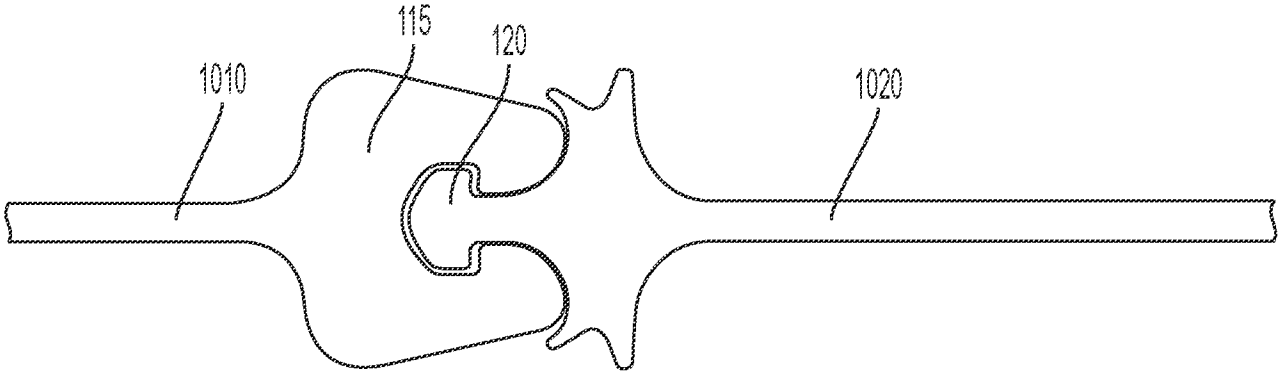
FIG. 10A and FIG. 10B show profile views of a cross-section of two embodiments of the zipper.
Figure 10B:
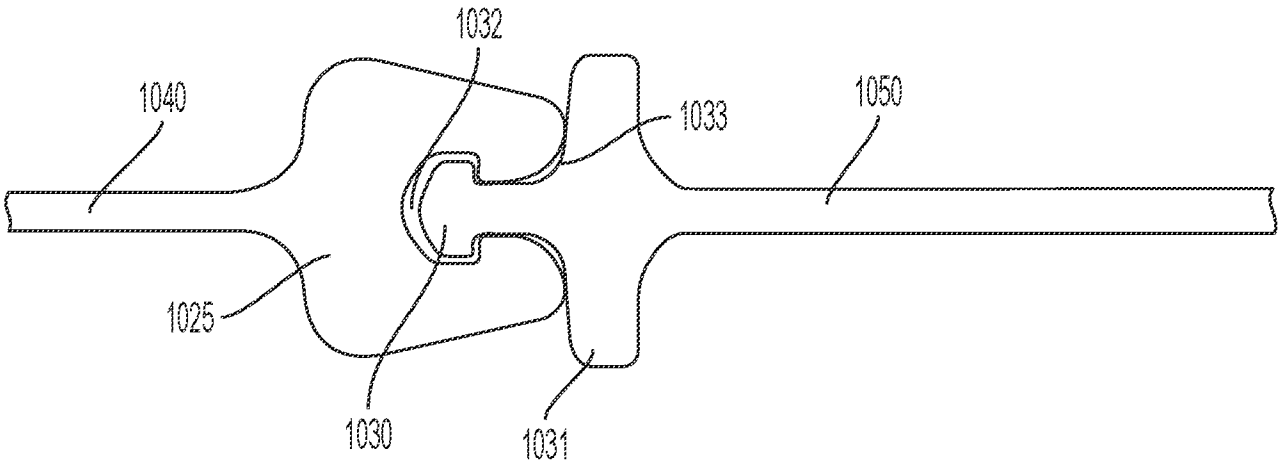

FIG. 10A and FIG. 10B show profile views of a cross-section of two embodiments of the zipper. In FIG. 10A a first zipper design is show having male side 120 and female side 115. Flange 1010 and flange 1020 may be used to attach the zipper to a bag or other item. FIG. 10B shows another embodiment. In this embodiment, female portion 1025 receives male portion 1030. A vacuum air pocket 1032 is created between the two. Additionally, a second intermediate space 1033 may be formed between female portion 1025 receives male portion 1030 that provides for more ready detachment of the sides, as the intermediate space/void provides for an area that provides for additional give in the system. Additionally, cross portion 1031 has been made smoother and more regular as compared to previous embodiments. This improved cross section provides for easier movement of the slider portion, providing less friction.

Figure 11:
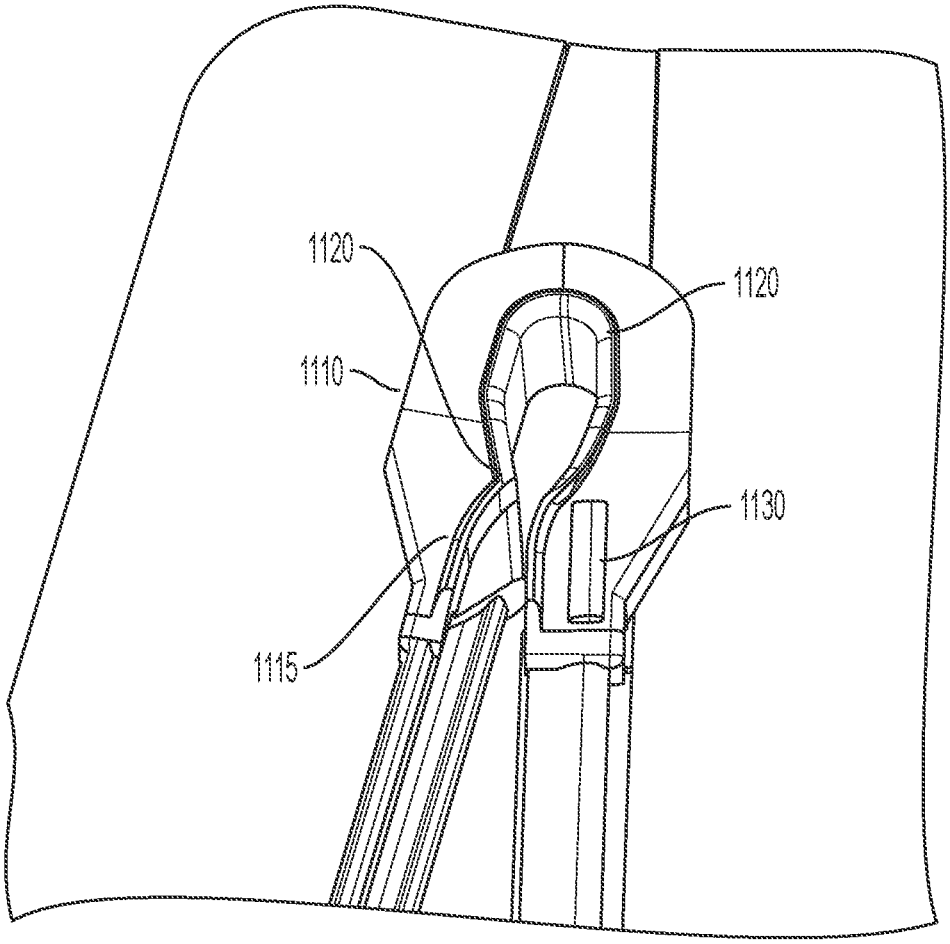
FIG. 11 shows an alternative embodiment of a zipper garage.

FIG. 11 shows an alternative embodiment of a zipper garage 1110. In this embodiment, male portion 1115 fits into female portion 1120. Male portion 1115 extends beyond the male protrusion on the side that it sits, and the angled edge on the interior of the zipper provides for a gradual transition from the male portion 1115 to the interion of the zipper. This also provides for smooth insertion and removal from the corresponding female portion, since as compared to a more perpendicular protrusion, this portion is angled according to the angle of separation of the sides. Additionally, the zipper garage 1110 includes a raised flange 1120 (this exists on both sides of the zipper). This raised flange seals against the interior of the zipper and prevents water from traveling into the aperture in the middle of the garage. Additionally, the zipper garage includes a raised portion 1130. This portion assists in the molding of the device and helps assure sufficient material is extruded to fill the garage. Additionally, this may assist in holding the slider in place when it engages the zipper garage.

Figures 12A, 12B:
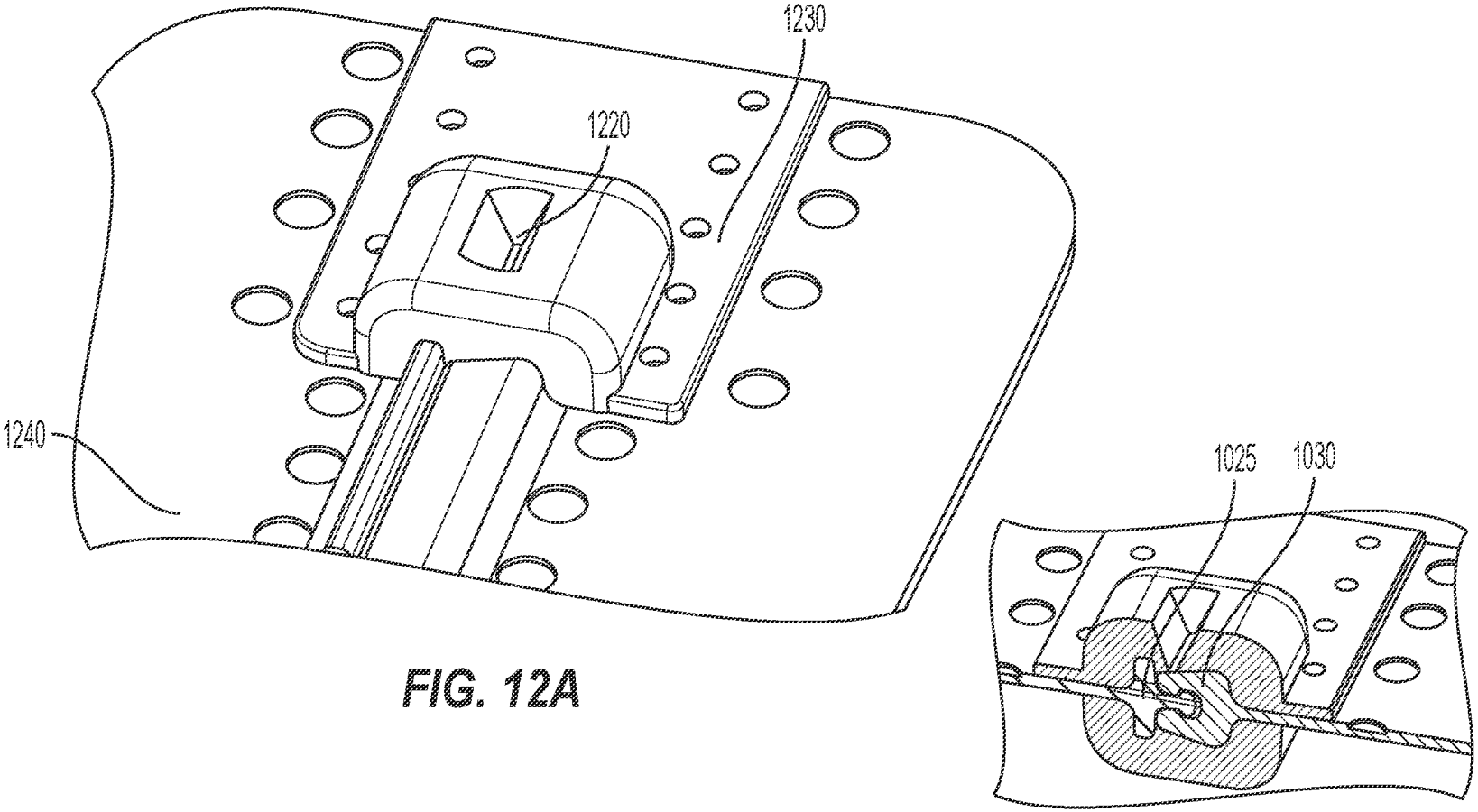
FIGS. 12A and 12B show the end of the zipper opposite the zipper garage.

FIGS. 12A and 12B show the end of the zipper opposite the zipper garage. Here, the flange of the zipper 1240 may be heat welded to the flange 1230 of the bottom garage. The bottom connection portion is positioned to completely surround the zipper in a watertight fashion. Cut 1220 may be included to help with flexibility and heat dispersion during the connection or overmolding process. The cross-section of 12B shows how the male portion 1025 and female portion 1030 sit in the bottom connection portion in an engaged fashion, such that they are watertight.

Figure 13:
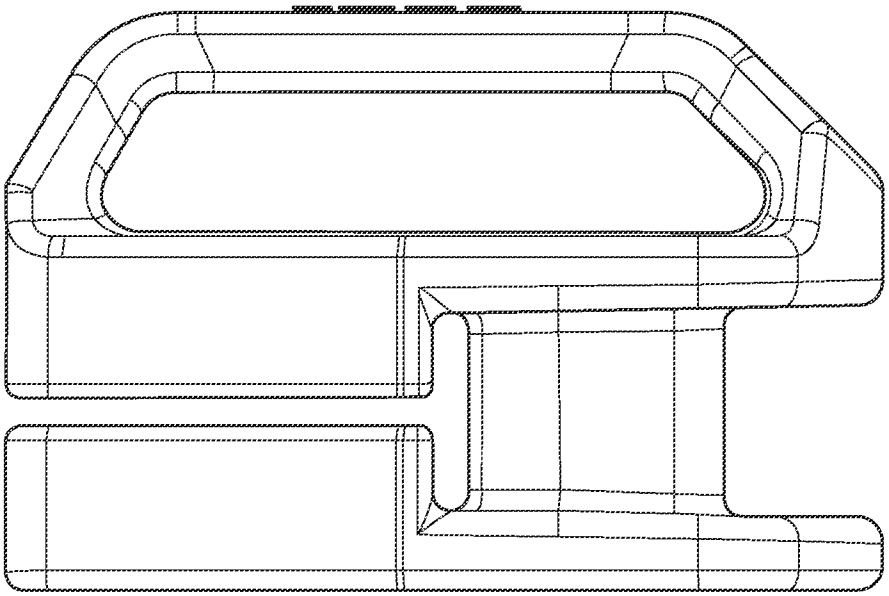
FIGS. 13, 14A, and 14B show embodiments of the slider.
Figures 14A, 14B:
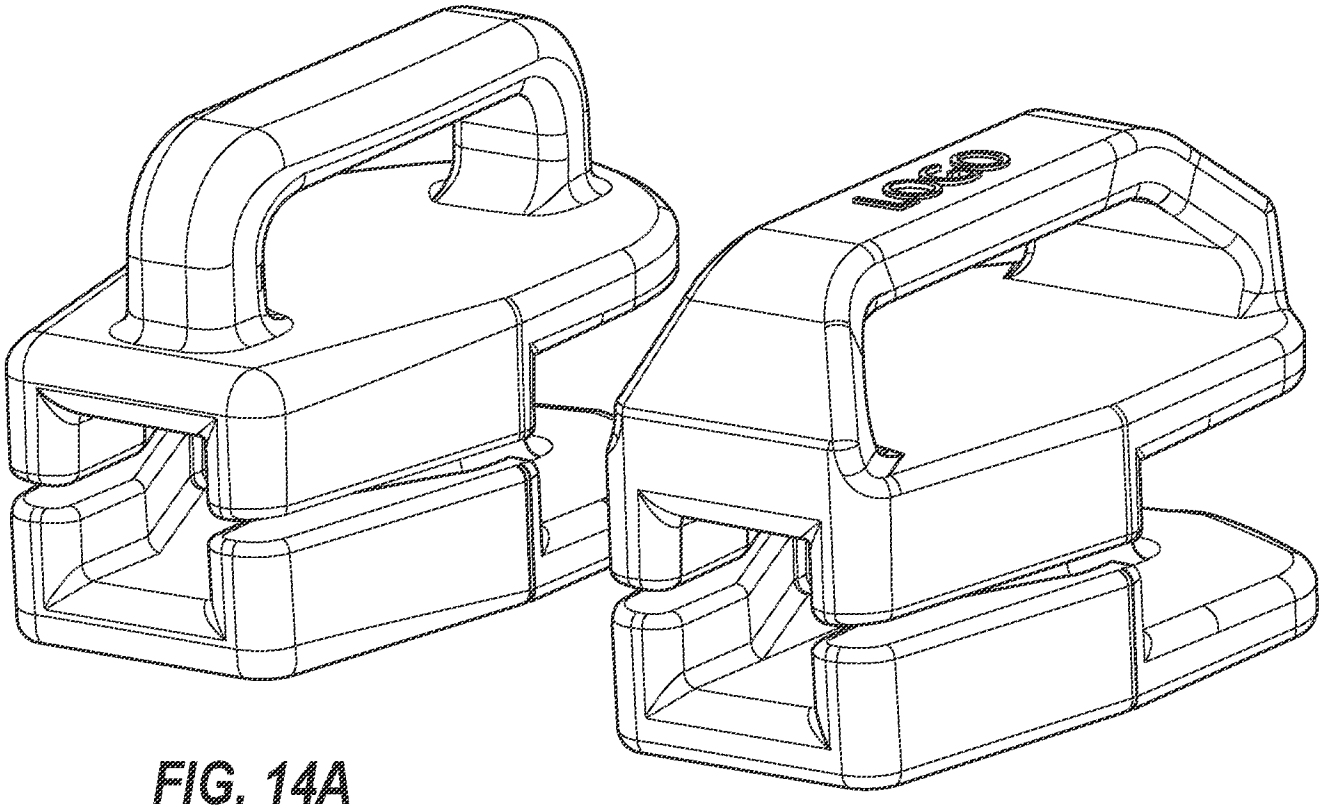

FIGS. 13, 14A, and 14B show embodiments of the slider, which essentially has a center post that fits into the void portion of the slider garage, an open end complementary with the shape of the wide end of the slider garage and a parallel guide that runs along the zipper in operation.

Figure 15:
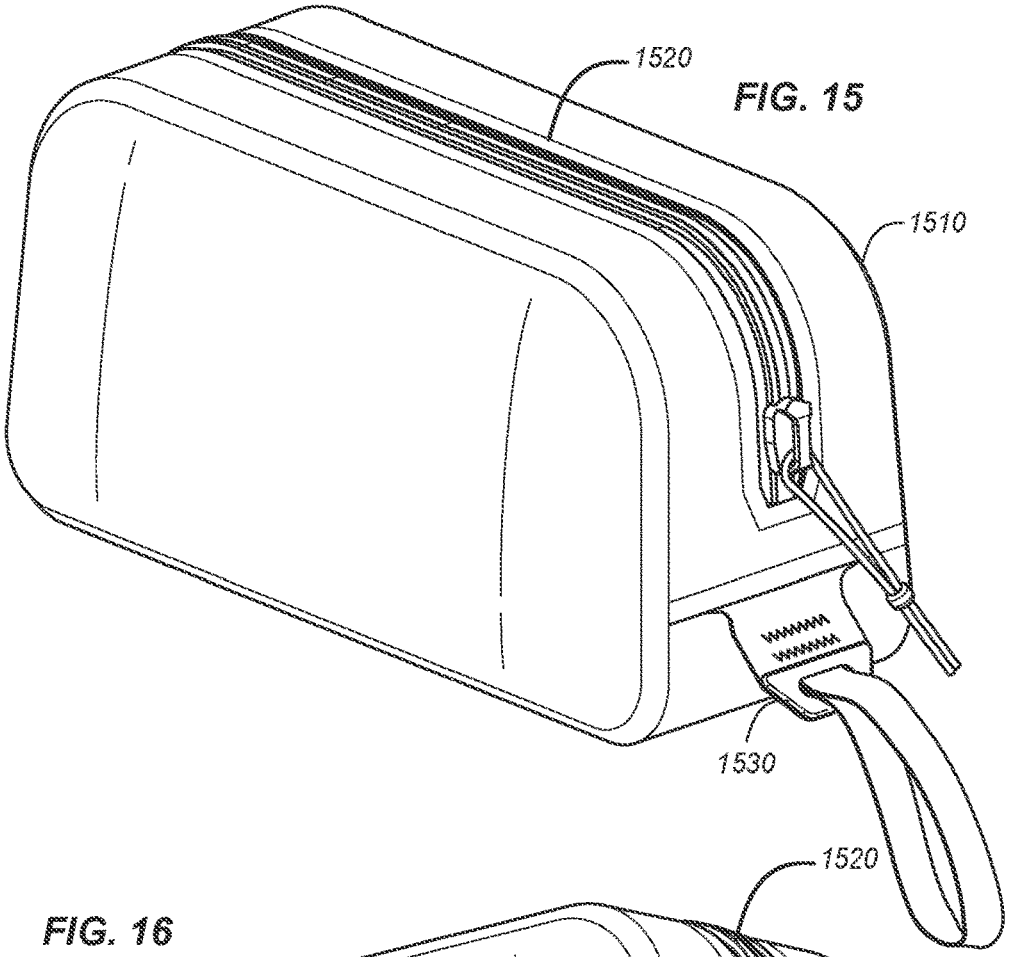
FIGS. 15-18 show two embodiments of waterproof bags utilizing embodiments of zippers including waterproof slider garages.
Figure 16:
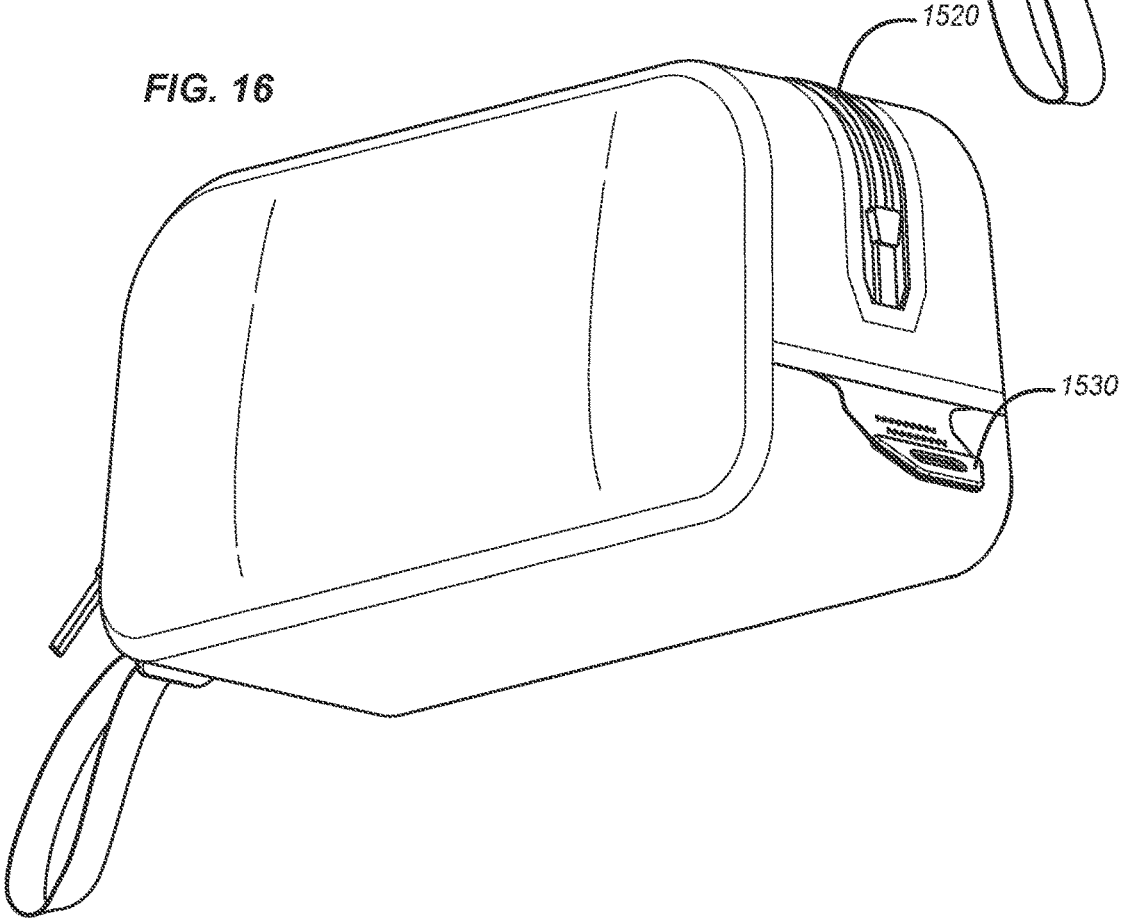
Figure 17:
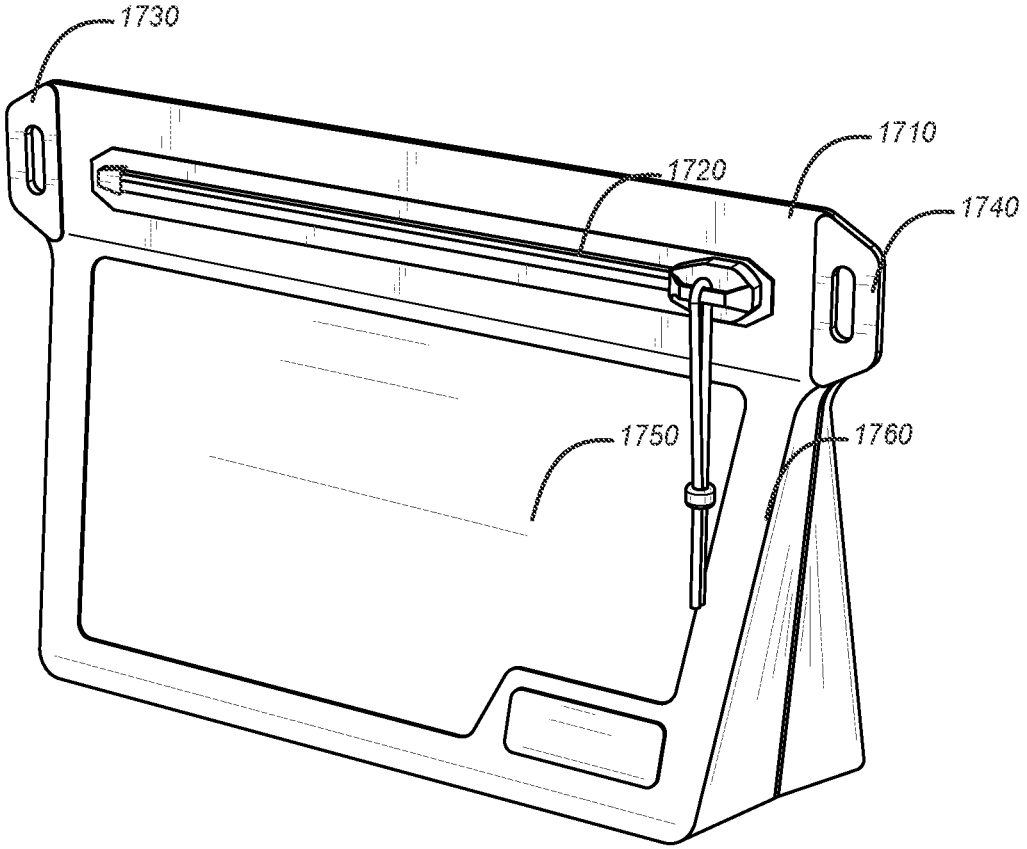
Figure 18:
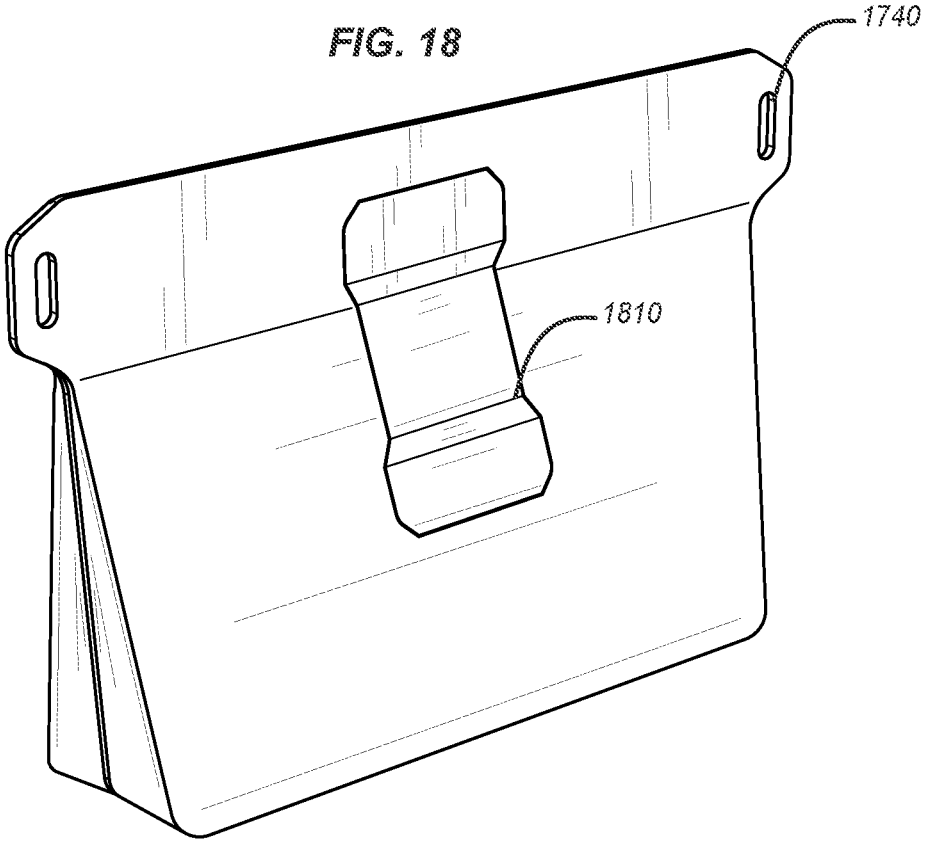

FIGS. 15-18 show two embodiments of waterproof bags utilizing embodiments of zippers including waterproof slider garages. FIGS. 15 and 16 show perspective views of one embodiment of a waterproof bag utilizing an embodiment of zipper including a waterproof slider garage. Bag 1510 includes waterproof zipper 1520 including slider garage. Additionally, bag 1510 includes pulls 1530. Pulls 1530 provide for leverage points to be used in the opening and closing of the zipper and they may accommodate straps or other attachment systems. In many embodiments, bag 1510 is composed of various types of a waterproof material and zipper 1520 is welded (heat welded) in place in bag 1510. FIGS. 17 and 18 show perspective views of one embodiment of a waterproof bag utilizing an embodiment of zipper including a waterproof slider garage. Bag 1710 includes waterproof zipper 1720 including slider garage. Additionally, bag 1710 includes pulls 1730, 1740. Pulls 1730, 1740 provide for leverage points to be used in the opening and closing of the zipper and they may accommodate straps or other attachment systems. In many embodiments, bag 1710 is composed of various types of a waterproof material and zipper 1720 is welded (heat welded) in place in bag 1710. As shown, bag 1710 includes an opaque portion 1760 and a clear portion 1750. This allows the user to see into the bag without releasing it. Additionally, in the rear view of the device, loop 1810 is shown for use in attaching the bag to a belt or other item.

Figure 19:
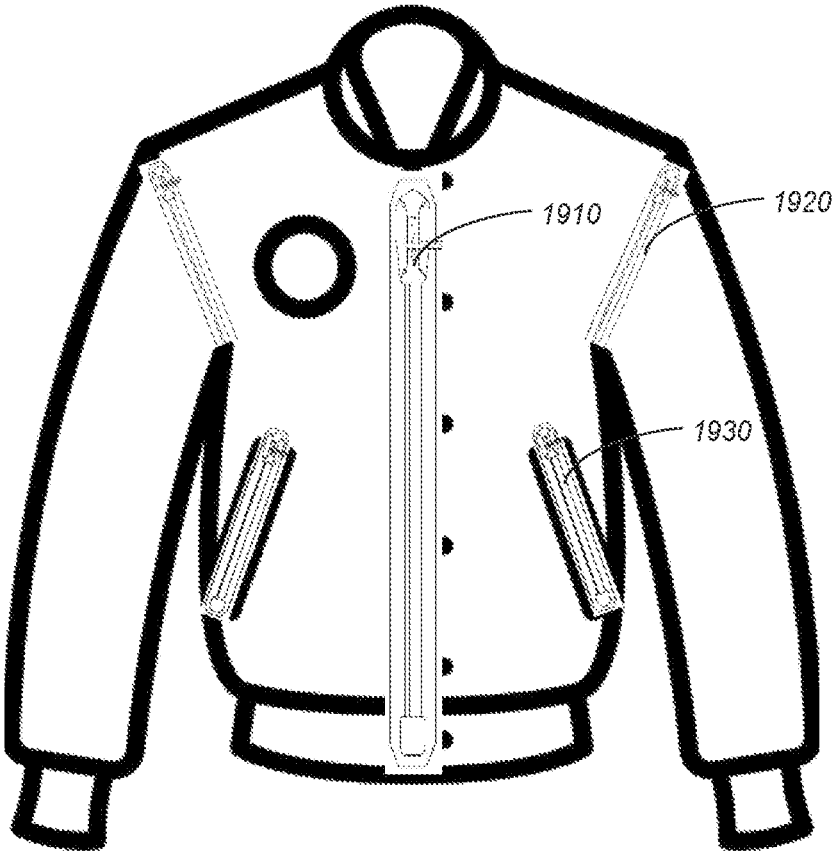
FIG. 19 shows an embodiment of a jacket including zipper systems.

FIG. 19 shows an example of an article of clothing, in this case a jacket, incorporating zippers in various locations as described above. As discussed herein, zipper system 1910, includes a closure at one end and an open end at the other. This allows for the closure of the jacket. For zipper system 1920, zip-off arms are shown. In the case of pocket closure zipper system 1930, one end of the zipper is closed and the other end includes a slider garage.

Figure 20:
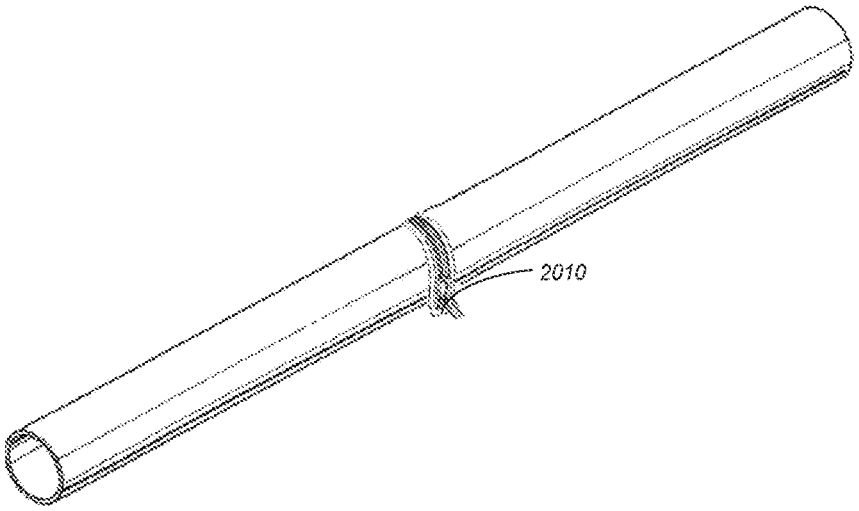
FIG. 20 shows an embodiment of tubes including zipper systems.

FIG. 20 shows an example of how tubes are joined via a zipper system 2010. In this case, each end of the tube includes one of a male and corresponding female zipper. The tubes may be formed of rigid, non-rigid, or semi-rigid material. Additionally, the open ends of the tubes may also include a male or female portion of a zipper to allow additional attachment.

Figure 21:
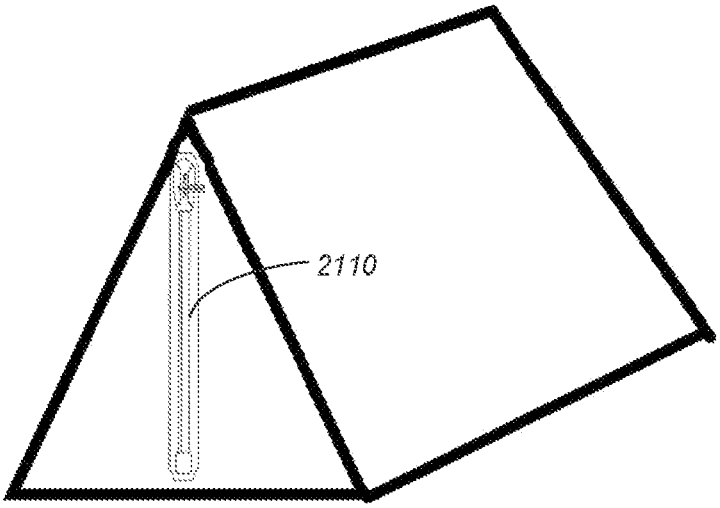
FIG. 21 shows a representation of a tent including a zipper system.

FIG. 21 shows an embodiment of a representation of how a zipper system 2110 might be deployed in a tent opening.

FIG. 22 shows an alternative embodiment of a zipper system 20. For zipper system 20, the broken lines indicate the locations where the end caps 40 are fused to the extrusions 30 and 31, during the over-molding process. Zipper system 20 includes two closed ends (end caps) and a male and female zipper portion. The locations are shown as dotted lines because the zipper assembly 20 is practically seamless, and the surfaces of the end caps 40 match those of the extrusions 30 and 31, to form a single surface around the entire perimeter of the zipper assembly 20 above, and a single surface around the entire perimeter of the zipper assembly 20 below. This provides for a hermetic seal, and an attachment area that runs 360 degrees around the zipper assembly 20 for installment.

This is a unique use of the over-molding process for assembly, which allows parts to be butted together to form a flat and continuous surface between parts. This saves on material costs, and on mold tooling complexity. In this case, the flat surfaces formed, allow the zipper assembly 20 to be bonded (in this case, RF welded, or any other method described herein) to the fabric of a garment or bag 10, so that a hermetic seal is possible between them. Overlapping portions, or material discontinuities, would otherwise make the step of complete sealing very difficult, if not impossible. In this usage, the over-molded end cap 40 uses the same material as the extrusions 30 and 31, which is of the same durometer/hardness, 80-90 Shore A. Any of the materials herein may be used however.

FIG. 23 shows one end of both mating parts, as a fastened fastener assembly 25. The male and female extrusions 30 and 31 are extruded, in this case.

The fastener assembly 25 is secured with a mechanical "ball-and-socket" union (a combination of a press fit and an interference fit) as well as with a vacuum. The female member 32 of female extrusion 30 accepts the male member 33 of male extrusion 31 to form a precision fit and a vacuum seal. The corresponding features shaped into each mating part 32 and 33 actually force all of the air out of the cavity 35 of fastener assembly 25, and creates what is called the vacuum fit. This special fit resists separation and bolsters the strength of the mechanical union between the two mating parts or extrusions 30 and 31 by mating surfaces 38 and 44.

Also, because all of the air is removed from between the two parts, female member 32 and male member 33, upon fastening, any capillary action that would otherwise fill voids or the cavity 35 with water (or other fluid) is prevented. Another hermetic seal is produced between the two extrusions 30 and 31.

FIG. 24 shows one of the female extrusions 30 by itself and one of the male extrusions 31 by itself.

Figure 25:
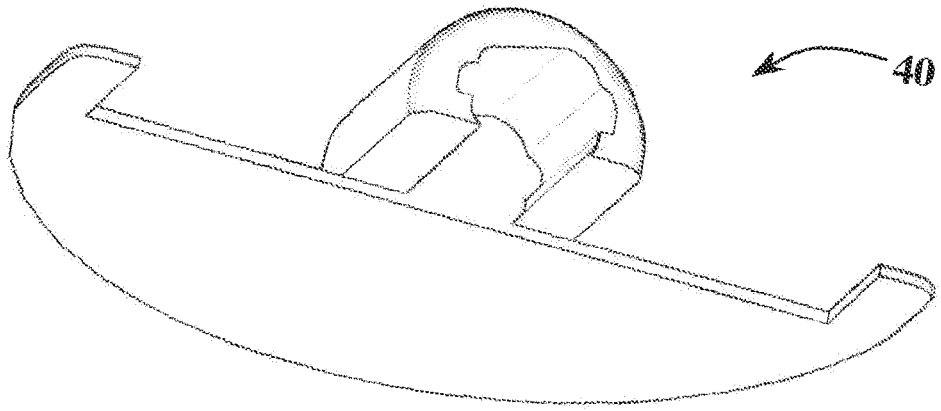
FIG. 25 shows an end cap for the zipper system of FIG. 22.

FIG. 25 shows a view from below an end cap 40. The end cap 40 is over-molded, onto the end of the zipper assembly 20, to form yet another hermetic seal. In this view, a cavity is visible, where the assembly of two mating extrusions 30 and 31 fit together and are located upon molding. (The thickness of the flange on the end cap 40 is the same as the thickness of the flange of each of the extrusion 30 and 31.) This is merely one possibility.

Figure 26:
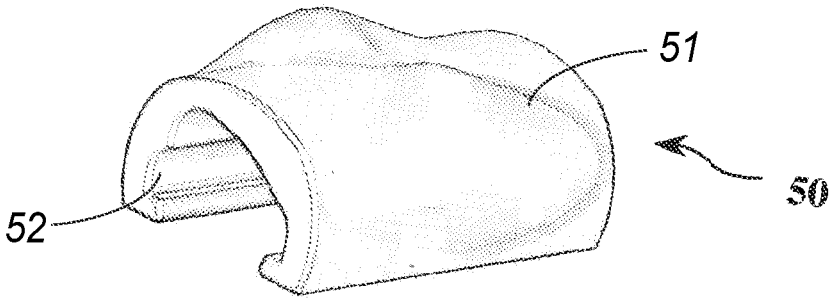
FIG. 26 shows a slider for the zipper system of FIG. 22.

FIG. 26 shows a close-up view of the slider 50. This part is in the shape of a housing 51 having an internal tunnel-like configuration with a pair of oppositely disposed grooves or slots 52 which slideably mate with the opposed extensions or protrusions 34 and 39 (see FIG. 24, 24), respectively. Slider 50 may be snapped into place over the male and female members 32 and 33 of fastener assembly 25 at any time, once the extrusions 30 and 31 have been mated. Although the fastener assembly 25 may be closed by using two fingers alone, the slider 50 can be used instead. The fastener assembly 25 then may be opened by pulling the openers 60 (as shown in FIG. 1) in substantially opposite directions.

The slider 50 is injection-molded of a hard plastic with a low coefficient of friction, in this case, acetal with 20% polytetrafluoroethylene (PTFE) (Teflon®). Any of the materials described herein are possible.

Figure 27:
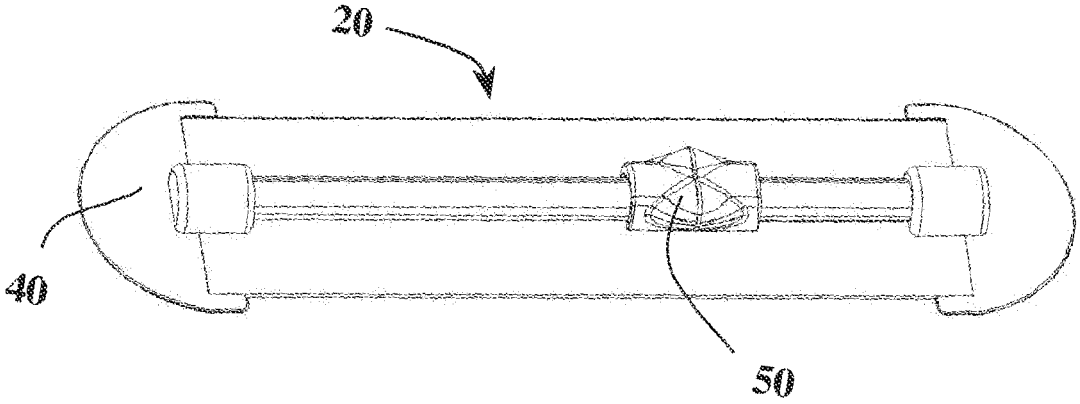
FIG. 27 shows an alternative embodiment of a zipper system.

FIG. 27 shows an alternate embodiment of the zipper assembly 20, which includes the slider 50. This view also shows the end cap 40 on either end of the zipper assembly 20.

The previous detailed description is of a small number of embodiments for implementing the systems and methods for creating a slider garage and the systems of slider garages and zippers and is not intended to be limiting in scope. The following claims set forth a number of the embodiments of the systems and methods for creating slider garages and the systems of slider garages disclosed with greater particularity.

The invention claimed is:

1. A zipper comprising:

a male zipper side, the male zipper side including a cross portion, the cross portion providing a smooth and regular edge;

a female zipper side, wherein the female zipper side receives the male zipper side and a first air pocket is created between the female zipper side and the male zipper side;

a slider garage at one end of the zipper;

a first flange, surrounding the slider garage, the first flange including a segmented portion that flexes, to provide for flexion of a first side of the slider garage and a second side of the slider garage, the flexion providing flexion of the first side away from the second side.

2. The zipper of claim 1, wherein the cross-portion interfaces with a slider positioned on the zipper.

3. The zipper of claim 2, wherein a second space is created between the female zipper side and the male zipper side.

4. The zipper of claim 3, wherein the female zipper side includes a socket portion and the male zipper side includes a ball portion and the ball portion engages the socket portion.

5. The zipper of claim 4, wherein the ball portion extends via a thin neck.

6. The zipper of claim 5, wherein the male zipper side includes a cross portion, the cross portion extending approximately perpendicularly away from the thin neck.

7. The zipper of claim 6, wherein the socket portion is u-shaped.

8. The zipper of claim 7, wherein the second space is located between a tip of the socket portion and the cross portion.

9. The zipper of claim 8, wherein the socket portion is curved at the tip and having a first curve and an intersection of the cross portion and the thin neck is curved and having a second curve, such that the second curve is greater in depth as compared to the first curve, therefore forming the second space.

10. The zipper of claim 9, wherein a first shape of the socket portion at the tip and a second shape at the intersection of the cross portion and the thin neck is such that the first shape and the second shape form the second space.

11. The zipper of claim 10, wherein the second space provides for more give in the zipper and provides for easier attachment of the male zipper portion from the female zipper portion.

12. The zipper of claim 11, wherein there is no break in the male zipper portion and the female zipper portion.

13. A zipper comprising:

a male zipper side, the male zipper side including a cross portion, the cross portion providing a smooth and regular edge, the cross-portion interfacing with a slider positioned on the zipper;

a female zipper side, wherein the female zipper side receives the male zipper side and a first air pocket is created between the female zipper side and the male zipper side a slider garage at one end of the zipper, the slider garage having a u-shape, the u-shape having a first side of the slider garage and a second side of the slider garage opposing each other;

a first flange, surrounding the slider garage, the first flange including a segmented portion that flexes, the segmented portion defined by a first flex line and a second flex line, to provide for flexion of the first side and the second side, the flexion providing flexion of the first side away from the second side.

14. The zipper of claim 13, wherein a second space is created between the female zipper side and the male zipper side, the female zipper side includes a socket portion and the male zipper side includes a ball portion and the ball portion engages the socket portion, the ball portion extends via a thin neck, the male zipper side includes a cross portion, the cross portion extending approximately perpendicularly away from the thin neck, and wherein the second space is located between a tip of the socket portion and the cross portion.

15. A zipper comprising:

a male zipper side;

a female zipper side;

a slider garage at one end of the zipper, the slider garage having a u-shape, the u-shape having a first side of the slider garage and a second side of the slider garage opposing each other and a third side between the first and the second side;

a first flange, surrounding the slider garage, the first flange including a segmented portion that flexes, the segmented portion along the third side.

* * * * *